US005209095A

United States Patent [19]

Kimura et al.

[11] Patent Number: 5,209,095

[45] Date of Patent: May 11, 1993

[54] MILL FOR PRODUCING STRIP AND USE THEREOF

[75] Inventors: Katsuhide Kimura; Kazuo Kubozoe, both of Ube; Tetsuo Okita, Tokyo, all of Japan

[73] Assignee: Ube Industries, Ltd., Yamaguchi, Japan

[21] Appl. No.: 729,129

[22] Filed: Jul. 12, 1991

[30] Foreign Application Priority Data

Jul. 13, 1990 [JP] Japan ..... 2-184105
Aug. 28, 1990 [JP] Japan ..... 2-224442

[51] Int. Cl.[5] ..... B21B 13/02; B21B 31/18

[52] U.S. Cl. ..... 72/241.4; 72/247

[58] Field of Search ..... 72/21, 199, 237, 238, 72/240, 241.2, 241.4, 241.8, 242.2, 243.6, 247; 100/160, 164

[56] References Cited

U.S. PATENT DOCUMENTS

| | | | |
|---|---|---|---|
| 1,953,190 | 4/1934 | Paterson | 72/241.4 |
| 2,040,400 | 5/1936 | Paterson | 72/241.4 |
| 2,271,459 | 1/1942 | McConnell | 72/241.2 |
| 3,693,385 | 9/1972 | Fujino et al. | 72/8 |
| 4,194,382 | 3/1980 | Kajiwara | 72/241.8 |
| 4,299,109 | 11/1981 | Matsumoto et al. | 72/243.6 |

FOREIGN PATENT DOCUMENTS

| | | | |
|---|---|---|---|
| 47-29260 | 11/1972 | Japan . | |
| 0103058 | 9/1976 | Japan | 72/241.4 |
| 0048050 | 5/1978 | Japan | 72/241.4 |
| 0010366 | 1/1980 | Japan | 72/241.4 |
| 0068107 | 5/1980 | Japan | 72/241.4 |
| 56-14362 | 4/1981 | Japan . | |
| 56-31161 | 7/1981 | Japan . | |
| 0116904 | 7/1983 | Japan | 72/243.6 |
| 59-18127 | 4/1984 | Japan . | |
| 0097702 | 6/1984 | Japan | 72/224 |
| 62-26843 | 6/1987 | Japan . | |

OTHER PUBLICATIONS

Hitachi's Technical paper, entitled "HC-Mill, Hitachi High Crown Control Mill" (not dated).

*Primary Examiner*—Lowell A. Larson
*Assistant Examiner*—Thomas C. Schoeffler
*Attorney, Agent, or Firm*—Finnegan, Henderson, Farabow, Garrett & Dunner

[57] ABSTRACT

A mill for producing a continuous strip comprising a pair of work rollers having a constant diameter over the work length, at least one local back-up roller having two rotatable contact surface sections, each provided to have a back-up effect on a corresponding work roller in a direct manner or an indirect manner. Each contact surface section is axially movable relative to the corresponding work roller. An overall back-up roller having a constant diameter over the work length may be provided between the local back-up roller and the work roller. Means for bending each work roller and/or each intermediate roller at the opposite neck portions thereof with a corresponding pair of the contact surface sections acting as fulcrums thereagainst. The mill is operated, while an axial position of each contact surface section is adjusted, and a hydraulic fluid supplied into each roller bending means forming a hydraulic cylinder is controlled in response to a profile of the strip.

37 Claims, 21 Drawing Sheets

MILL FOR PRODUCING STRIP AND USE THEREOF

BACKGROUND OF THE INVENTION

1. Field of the Invention

The present invention relates to an improved mill or rolling machine for use in the iron/steel industry and the non-iron field, and for producing a continuous strip of steel or the like with a desired thickness over the entire width by forcing a material to be rolled between a pair of work rollers or rolls. Further the present invention relates to an improved method of producing a strip using the above improved mill.

2. Description of the Related Art

A conventional 4-stage rolling machine or 4 high mill is schematically shown in FIGS. 8 to 11 attached hereto. In the figures, a pair of upper and lower work rollers or rolls 1 and 2 to be directly used for rolling the strip materials to a desired plate thickness are supported rotatably by work roller bearings of a chock type 15 and 16 respectively on both the ends. Both diameters of these upper work roller 1 and lower work roller 2 are usually invariable in an axial direction of work rollers 1 and 2.

A pair of overall upper and lower back-up rollers 3 and 4 usually having a crown shape as shown in FIG. 13*a* (the diameter of central portion of back-up rollers 3 and 4 is larger and the diameter becomes smaller at both ends) are supported rotatably by the back-up roller bearings 17 and 18 respectively in the manner of sandwiching said pair of upper and lower work rollers 1 and 2. Further, the diameter of afore-mentioned upper and lower back-up rollers 3 and 4 is designed to be larger than the diameter of upper and lower work rollers 1 and 2, and both pairs of the overall back-up rollers 3 and 4 or of work rollers 1 and 2 usually have the same diameter. The above conventional back-up roller or roll may be called "an overall back-up roller", since it has a backing-up effect overall on a corresponding work roller. When pressure oil has been introduced into a milling or rolling cylinder or ram 8, so called "push-up ram" installed inside the housing 10 from the pressure oil supplying unit that is not shown in the figure, the lower back-up roller bearing of a chock type 18 at both ends of lower back-up roller 4 is pressed upward as shown in FIG. 10. The push pressure P from this lower back-up roller 4 is transmitted to the lower work roller 2 of small diameter which comes in contact with each other and turns in the opposite direction and becomes the rolling force against plate material 5 inserted between the upper and lower work rollers 1 and 2.

Further, by the reaction force R during the rolling of plate material 5 being inserted between the upper and lower work rollers 1 and 2, the upper work roller 1 is apt to be bent to a convex shape while the lower work roller 2 is bent to a concave shape. These reaction forces R hold a pair of upper and lower work rollers 1 and 2 from both the upper and lower sides and are transmitted to the back-up rollers 3 and 4 which turn in opposite direction and are in contact with each other, while the back-up rollers 3 and 4 are larger in diameter and stronger in rigidity than the work rollers 1 and 2, so the reaction forces R being transmitted from the work rollers 1 and 2 are alleviated. As shown in FIG. 12 during this rolling, there appears the difference in thickness (H−h) between the thickness "h" of end portion of plate material 5 and the thickness "H" of central portion, and in the cross sectional view that has been cut in the direction perpendicular to the feed direction of plate material 5, the upper/lower shapes of strip material 5*a* rolled and coming out between the upper and lower work rollers 1 and 2 are not flat, or are apt to be rolled to the strip material 5*a* of so-called edge waved shape where the thickness at the central portion of strip material 5*a* becomes thicker while both the ends become thinner.

A variety of proposals are being presented so that the upper/lower faces of the plate can be rolled flat while the resultant strip material can be prevented from attaining an edge-waved shape.

One is the method called a roller bending method where a bending cylinder is installed at the roller neck. This technique is mainly applied to such a 4 stage rolling machine and is used to forcedly bend the work roller by the external force to change the roller crown. This method is applicable in the work roller bending method and the back-up roller bending method.

There is also another technique named the VC roller method wherein an oil chamber is laid out inside the rolling roller and the oil pressure acting therein is adjusted for changing the crown of the work roller.

In addition to them, there is the heat crown method for thermally expanding a part of the work roller to change the crown, and there is the roll coolant method for theremally reducing a part of the work roll diameter by adjusting a coolant volume. The above mentioned roller bending technique is the method rich in conformity and contains a certain degree of flexibility as described above, but because the work roller is restricted to the entire face of the back-up roller as shown in FIG. 13(*a*) and FIG. 13(*b*), it is difficult to provide a sufficient deflection to the work roller and not only lacks in absolute capability but the back-up roller needs to be changed in view of the width, strength, shape and the like of plate material for changing the crown of the back-up roller. Further, the VC method is expensive due to the cost of the back-up roller. Its maintenance is also troublesome.

In addition, the heat crown method and the roll coolant method involve a great problem in that its responsibility is poor, though both methods are very flexible.

Further, in the above 4-stage rolling machine, it is noted that there is a limit to its shape controlling function, and it was difficult to say that said machine was sufficiently effective in controlling against edge drop where the wall thickness on the side edge portions of rolled material 5 decreased continuously. For this reason, in order to enhance the shape controlling and crown controlling effects, a 6-stage rolling machine or 6-high mill has been proposed and has been actually used (JP Unexamined Patent Publication No. 47 (1972)—29,260). This machine tries to adjust the distribution of rolling forces for enhancing the shape correcting function by arranging the intermediate rollers 6 and 6' between work rollers 1 and 2 and overall back-up rollers 3 and 4 as shown in FIG. 14. And such a technique also proposes that the counterplan controlling against edge drop becomes effective by adjusting the roller bending force and the shift distances of intermediate rollers 6 and 6' (JP Examined Patent Publication No. 56 (1981)—14,362).

However, in the said conventional rolling machine, there are such defects that it is difficult to give a sufficient roller bending force to the work rollers because the work rollers 1 and 2 and the intermediate rollers 6 and 6' are constrained by almost all the entire faces of back-up rollers 3 and 4, and that not only the said machine is lacking in absolute shape control capability but the back-up roller also needs to be re-assembled for changing the crown shape in view of the plate width, strength, shape and the like of rolled material especially in a 4-stage rolling machine. In addition, because the shift direction by intermediate roller is limited to a single direction in the conventional 6-stage rolling machine, an undulation along the plate width direction of rolled material sometimes appears even after the enforcement of the crown control, and it is difficult to obtain a sufficient shape controlling function in the said machine. Still more, because the back-up rollers turning in contact with the work rollers and intermediate rollers are in contact with almost all the entire faces, it is impossible to optionally change the back-up fulcrum and to control the shape at an optional position. In addition, the back-up rollers need to be ground on their entire faces and a sufficient space is required at the side of the rolling machine because of the difficulty in maintenance and the shift mechanism of the intermediate rollers.

SUMMARY OF THE INVENTION

An object of the present invention is to provide, with attention given to the said conventional problematic points, a rolling method and machine not only having the conformity capable of responding to the ever changing conditions in high speed rolling work, but also capable of vastly increasing the work roller bending control degree, thereby enhancing the shape controlling capability in addition to decreasing the edge drop, and moreover capable of conducting the shape control at an optional position in the plate width direction of rolled material.

According to the present invention, there is provided a mill for producing a continuous strip comprising: a roll stand; a pair of upper and lower work rollers (usually having a constant diameter over a work length thereof) rotatably mounted on the roll stand at the opposite ends thereof, through which rolls a material of steel or the like is forced to pass under a rolling pressure; means provided in the roll stand for exerting a rolling force to the working rollers to thereby produce the rolling pressure; means for bending neck portions of the paired work rollers as needed, provided in the roll stand at opposite ends thereof; and at least one local back-up roller mounted on the roll stand at the opposite ends thereof, said local back-up roller having a pair of rotatable contact surface sections radially projecting and axially arranged to thereby have a back-up effect on a corresponding work roller at two local areas thereof. Each contacting surface section is axially movable relative to the corresponding work roller, as needed. There may be a conventional overall back-up roller (usually having a constant diameter over a work length thereof) with an overall contact surface, provided to have a back-up effect overall on a corresponding work roller. The paired work rollers are located between the local back-up roller and the overall back-up roller.

Alternatively, there may be an overall back-up roller having a constant diameter over a work length thereof with an overall contact surface, provided between the local back-up roller and a corresponding work roller, acting as an intermediate back-up roller.

Preferably, each local back-up roller has a main shaft and a pair of back-up unit or device. Each device comprises: a support roller rotatably and coaxially mounted on the main shaft; a housing axially holding the support roller, a threaded shaft axially screwed into the housing; and means for rotating the thread shaft to thereby adjust an axial position of the support roller. The support rollers provides the contact surface sections of the local back-up roller.

Further, according to the present invention, there is provided a method of producing a strip using the above mill, comprising adjusting the axial position of the contact surface sections of each local back-up roller, and controlling a hydraulic fluid supplied into each roller bending means forming a hydraulic cylinder in response to a profile of the strip, wherein each contacting surface section of the local back-up roller acts as a fulcrum against the work roller or the intermediate roller when the work roller or the intermediate roller is bent by the roller bending means.

BRIEF DESCRIPTION OF THE DRAWINGS

FIG. 3(*b*) is a cross-sectional view of the local back-up roller from A—A of FIG. 3(*a*);

FIG. 8 to FIG. 13 show conventional examples similar to the present invention, wherein FIG. 8 is a plane view of 4-stage mill or rolling machine, FIG. 9 a vertical sectional view from IX—IX of FIG. 8, FIG. 10 an enlarged sectional view of the rolling machine from X—X of FIG. 9, FIG. 11 is an enlarged sectional view of a roller bending cylinder from XI—XI of FIG. 10, FIG. 12 is a roller deflection due to the push-up pressure exerted by a milling cylinder or ram, and FIGS. 13(*a*) and 13(*b*) are schematic views illustrating the crown in different situations;

PREFERRED EMBODIMENTS OF THE INVENTION

Figure 1:
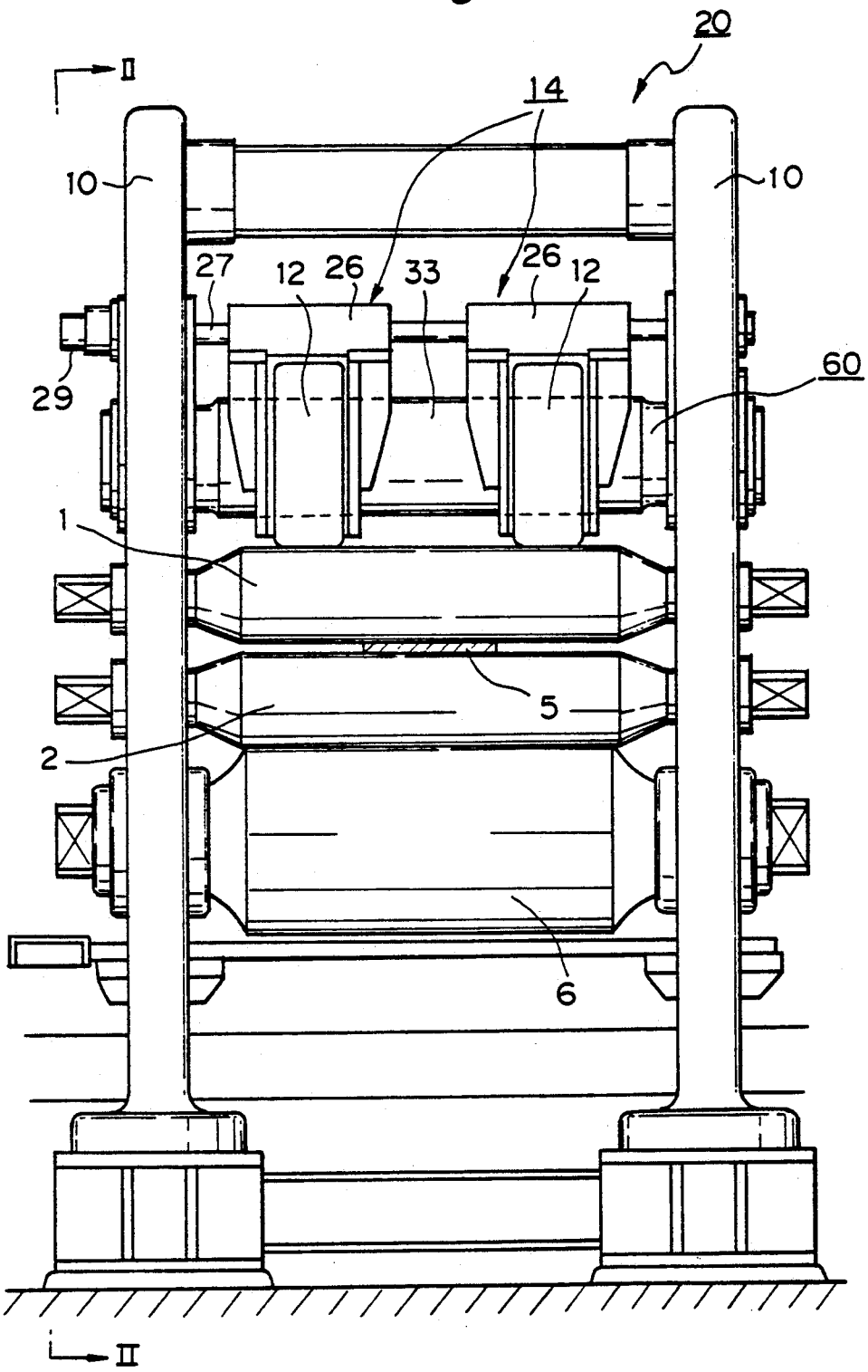
FIG. 1 is a front view of a first embodied 4-stage rolling machine of the present invention.
Figure 2:
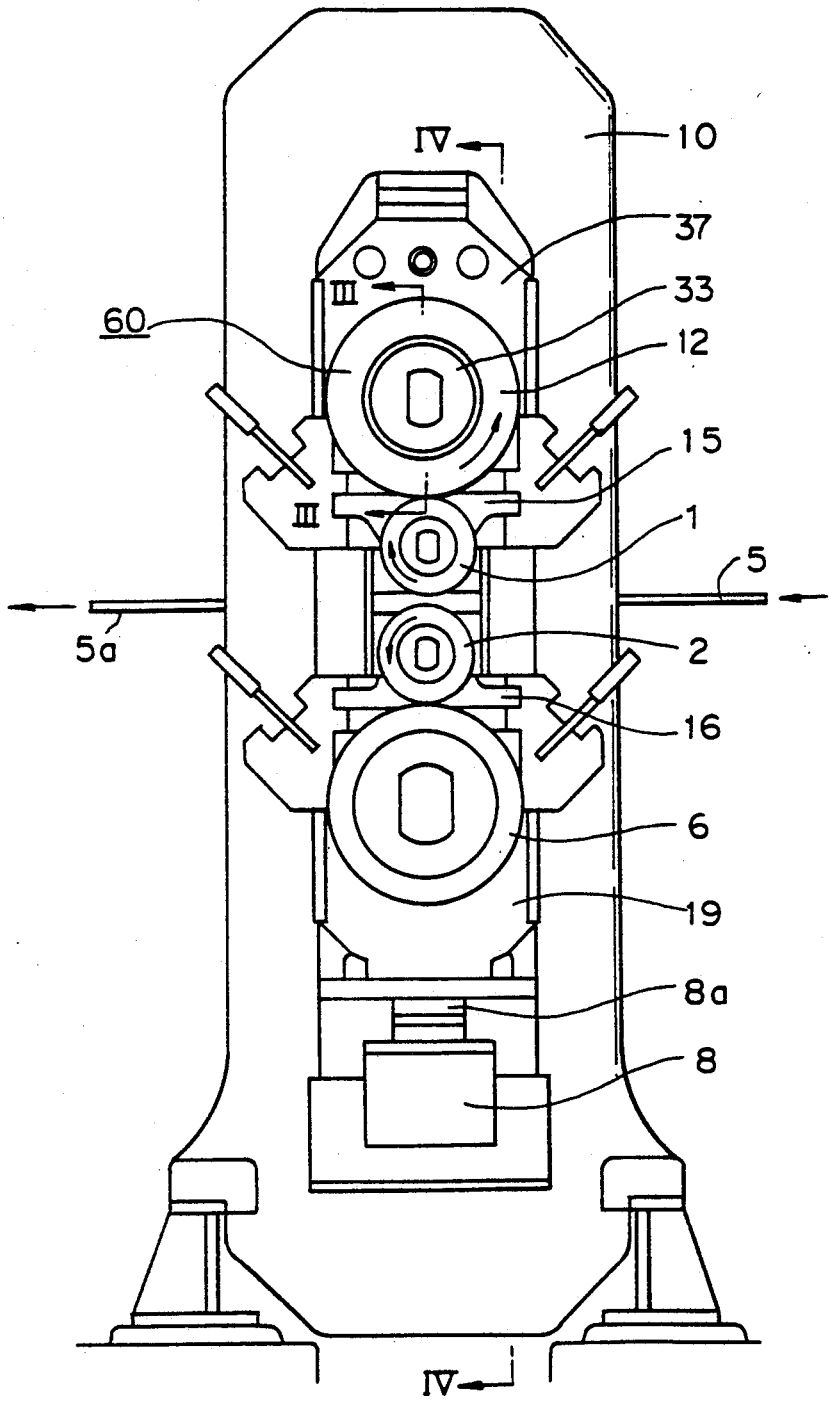
FIG. 2 is a side view of the machine from II—II of FIG. 1.

Referring to FIGS. 1 to 7, a rolling machine 20 of the present invention comprises a local back-up roller 60 provided with a pair of support rollers 12, work rollers of a chock type 1 and 2, overall back-up roller 6, work roller bearings 15 and 16, back-up roller bearing of a chock type 19, back-up shaft bearing of a chock type 37, milling or rolling cylinder or ram 8, roller bending unit 9 and roll stand or housing 10. For reference, reference number 5 denotes a continuous plate material. The support rollers 12 provide contact surface sections of the local back-up roller.

Reference numerals 1 and 2 are work rollers directly provided for the rolling of plate material 5, and the diameters of upper work roller 1 and lower work roller 2 are usually invariable in the axial direction. The upper work roller 1 and the lower work roller 2 are adjusted by the milling cylinder 8 for rolling the plate to the desired thickness of plate material 5.

The work roller bearings 15 and 16 are provided to rotatably support the shafts of the upper and lower rollers 1 and 2, and both ends of upper work roller 1 are supported for free rotation by a pair of upper work roller bearings 15 installed inside standing frames of the housing 10 which are erected on both sides of the rolling machine 20. In addition, both the ends of lower work roller 2 are also supported for free rotation by the lower work roller bearings 16, as those of the upper work roller 1.

The back-up roller bearing 19 is provided to support the back-up roller 6 for its free rotation, and installed inside each standing frame, similar to the other bearings. If the milling cylinder head 8*a* is pushed upward by the pressure oil guided into the milling cylinder 8 during the rolling process, the back-up roller bearing 19 in contact with the milling cylinder head 8*a* is also pressed and this push pressure contributes to the rolling of plate material 5 via the lower work roller 2 from the back-up roller 6.

Reference number 33 is a back-up shaft of the local back-up roller 60, and both ends are supported by the back-up shaft bearings 37 installed inside the standing frames.

Next, a back-up device or support roller adjusting unit 14 according to this invention is explained. The local back-up roller 60 provided with the paired back-up devices 14 is arranged on the upper work roller 1.

The support roller adjusting unit or back-up device 14 comprises support roller 12, bearing 21 for the support roller, thrust bearings 22 and 23, internal ring 24, thrust bearing support 25, casing or housing 26, guide rod 27, transfer screw 28 and electric motor 29.

A pair of support rollers 12 having a circular shape are supported rotatably on the upper work roller 1 by the bearing 21 for support roller, and during the rolling work, the outside circumferential faces of the support roller 12 and the upper work roller 1 are rotating in opposite direction while they get in contact with each other. The thrust bearings 22 and 23 are subjected to the thrust force being exerted to the support roller 12 during the rolling work.

Moreover, meeting the width size of plate material 5 and the plate shape, a pair of support rollers 12 are laid out in such a way that their position may be brought closer to or separated from in an axial direction mutually along the outside circumferential face of upper work roller 1. As shown in FIG. 3(*b*), the screw groove is engraved and extends in the movement direction of support roller 12 in the central area of casing 26 where the upper support roller is held, and both ends of transfer screw 28 inserted in engagement with the screw groove of the holes inside this casing 26 are supported for free rotation by the back-up shaft bearing 37 installed inside the housing 10. The guide rods 27 are installed in combination to both sides of transfer screw 28 which has been inserted into the casing 26.

In addition, the said transfer screw 28 is engraved to the right and left, forming a right screw section and a left screw section from the central area of shaft center direction. An electric motor 29 is connected directly to one end of this transfer screw 28 so that a pair of support rollers 12 may be brought closer to or separated from each other by the forward or positive/reverse rotary directions of electric motor 29, and the position or distance between both the support rollers 12 can be decided appropriately by driving the electric motor 12 in response to the width size of the plate material 5.

Reference numeral 9 is a roller bending unit, which is structured of upper roller bending rod 9*a*, lower roller bending rod 9*b*, roller bending cylinder block 9*c* and piston 9*d*.

The lower end of upper roller bending rod 9*a* is fixed to a piston 9*d*, whereas its upper end is laid out for free contact with and separation from the upper work roller bearing 15. Further, to the contrary to the said upper roller bending rod 9*a*, the piston 9*d* is fixed to the upper end of lower roller bending rod 9*b*, and its lower end is laid out for free contact with and separation from the lower work roller bearing 6.

A communicating hole or small diameter 9*d* is provided to the central area of roller bending cylinder block 9*c*, and if the pressure oil is guided here from a pressure oil supplying unit not shown in the figure, the upper and lower roller bending rods 9*a* and 9*b* engaged to the roller bending cylinder block 9*c* separate mutually from each other, and the respective tip portions of roller bending rods 9*a* and 9*b* function to press the upper and lower work roller bearings 15 and 16.

During the pressing process, because a liner 9*f* is fitted to the side of upper and lower work roller bearings 15 and 16 of outside circumferential wall of roller bending cylinder block 9*c* and moreover a liner 9*g* is fitted to the outside circumferential face on the side of roller bending cylinder block 9*c* of upper and lower work roller bearings 15 and 16 respectively, the upper and lower work roller bearings 15 and 16 are to be in the form of being pushed upward and downward along the contact face 9*h* of both these liners 9*f* and 9*g*, where the bending moment is likely to act with the contact face of support roller 12 acting as a fulcrum against the upper work roller 1, and the profile of upper work roller 1 of the diameter having a convex shape is so modified that it is corrected from the convex shape into a flattened shape.

Reference numeral 8 is a milling or rolling cylinder or ram, provided with a head 8*a* for vertical movement, in engagement with the milling cylinder 8, and if the pressure oil is guided into the milling cylinder from the oil supplying unit not shown in the figure during the rolling process, the tip portion of head 8*a* gets in touch with and presses the lower portion of the back-up roller bearing 19 following the rise of head 8*a* so as to push upward the back-up roller 6. The pushing force of the tip portion exerts as the rolling force for correction of strip material 5a via the lower work roller 2 turning in opposite direction in contact with the back-up roller 6.

The operation of rolling machine that has been structured as mentioned above is to be explained.

The axial position of support roller 12 should be predetermined to meet the width of plate material 5 before rolling the plate material 5.

When a series of preparations of rolling machine 20 has been completed, the plate material 5 is inserted between the upper work roller 1 and the lower work roller 2. While passing through and between a pair of upper and lower work rollers 1 and 2, the plate material 5 is rolled to a strip material 5a having the desired upper/lower flattened faces. The shape of strip material 5a has conventionally been judged by a manual visual method on this occasion, but in order to eliminate the individual differences and/or enhancing the inspection accuracy, it is possible to perform the said shape judgement by a contact system with use of a sensor roller or by a non-contact system utilizing a light or a magnet.

The edge waved shape (the central area of strip material 5a is thick while both the ends are thin) or the center buckled shape (the central area of strip material 5a is thin while both the ends are thick) can be prevented by transversely shifting the support roller 12 in the axial direction of upper work rollers 1 and 2 or by controlling the pressures of bending cylinder 9a and 9b so that the said strip plate material 5a may have the desired shape.

Figure 6:
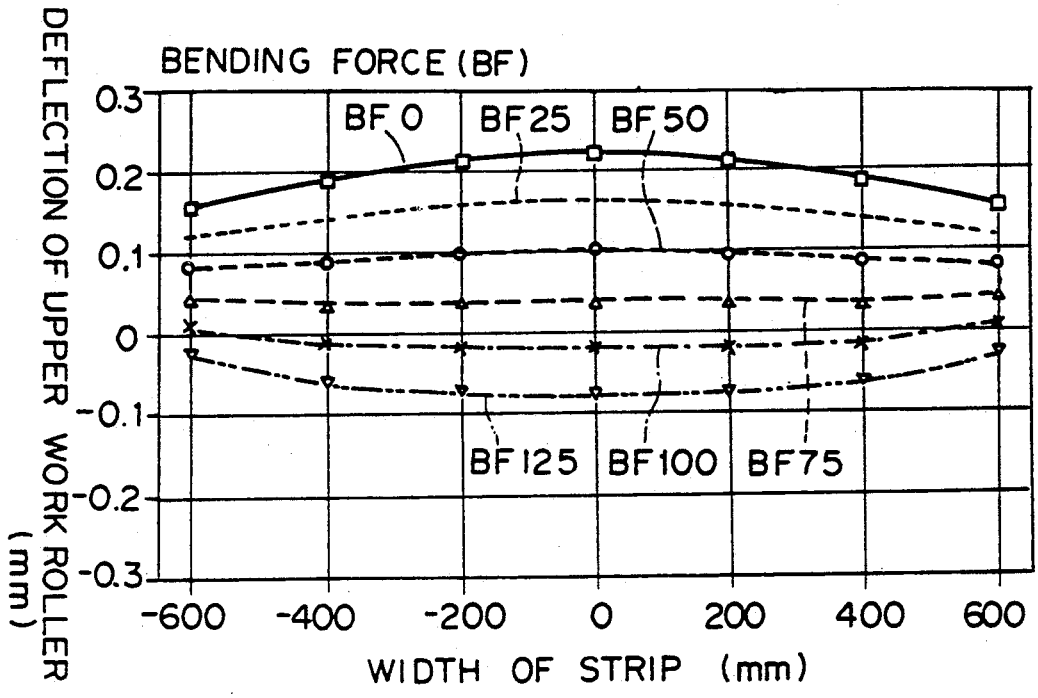
FIG. 6 and FIG. 7 are diagrams showing profiles relating to the control of upper work rollers of a 4-stage rolling machine to which the present invention has been applied.
Figure 7:
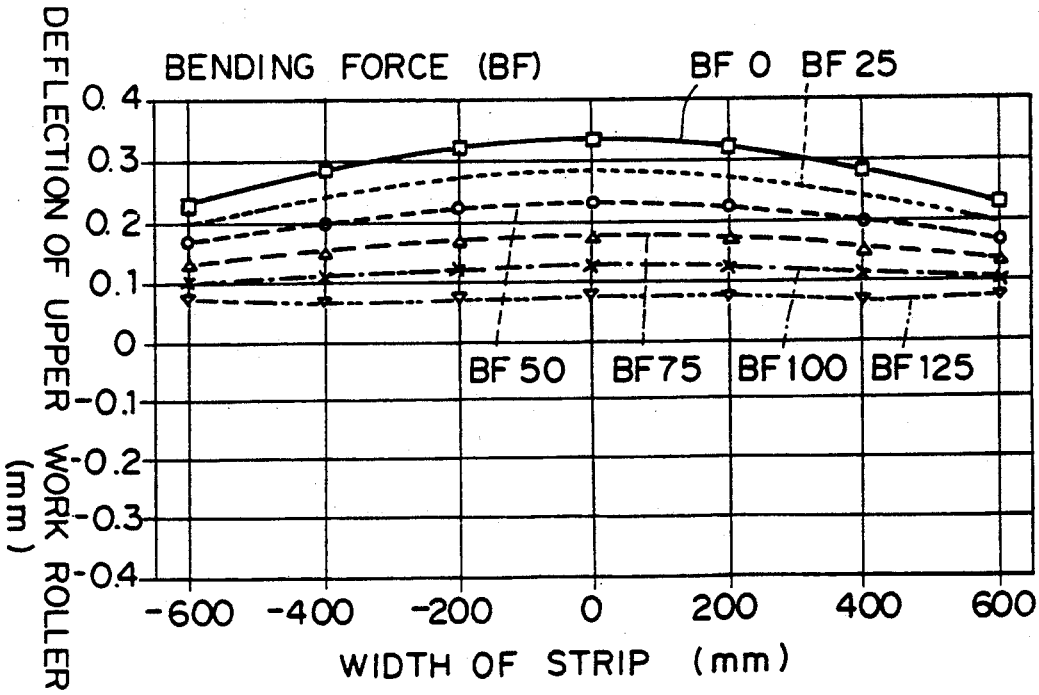
Figure 8:
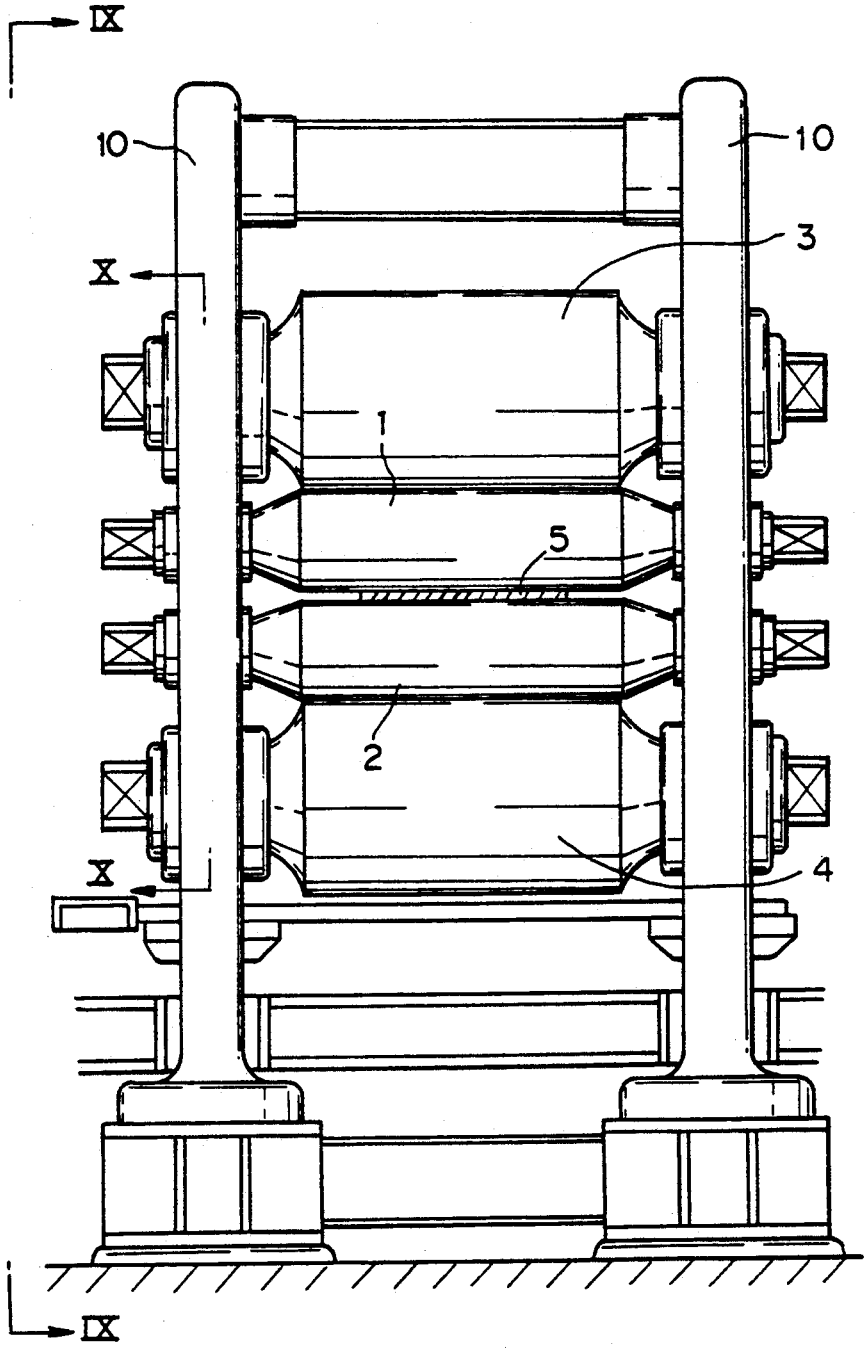
Fig. 8 PRIOR ART
Figure 9:
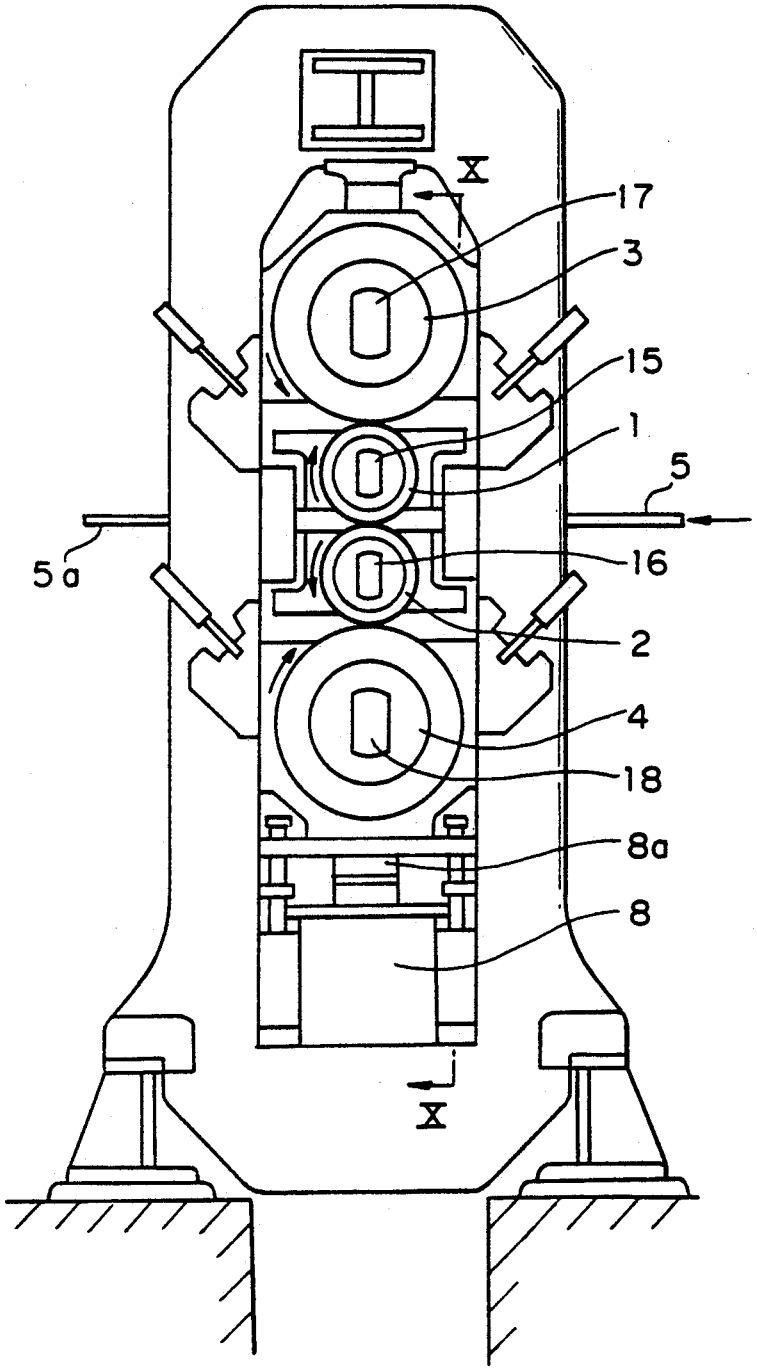
Fig. 9 PRIOR ART
Figure 10:
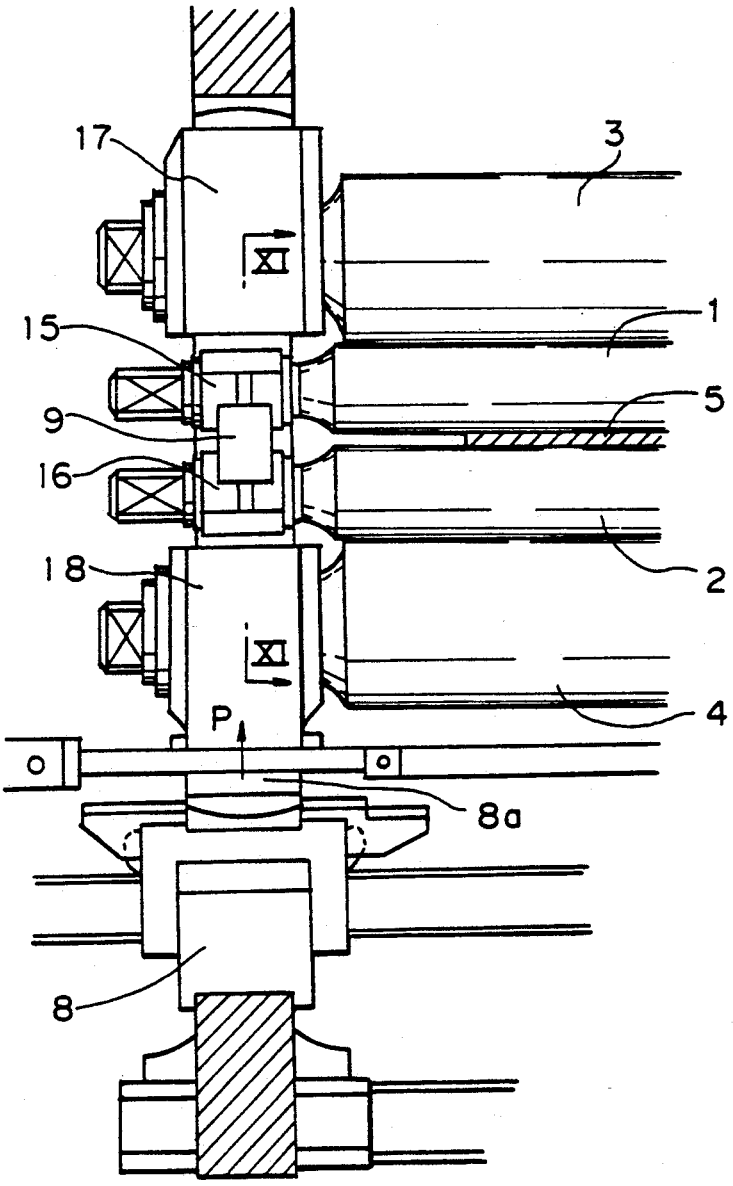
Fig. 10 PRIOR ART
Figure 11:
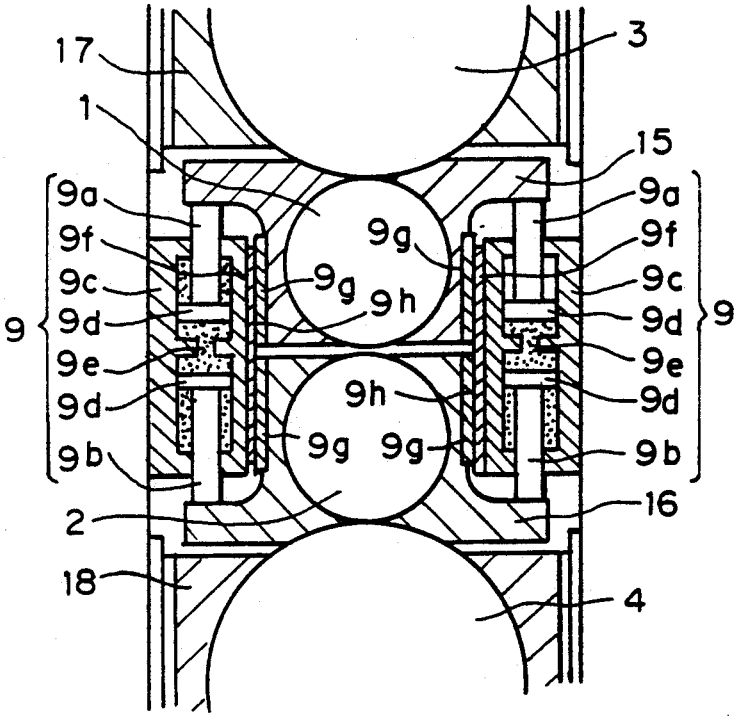
Fig. 11 PRIOR ART
Figure 12:
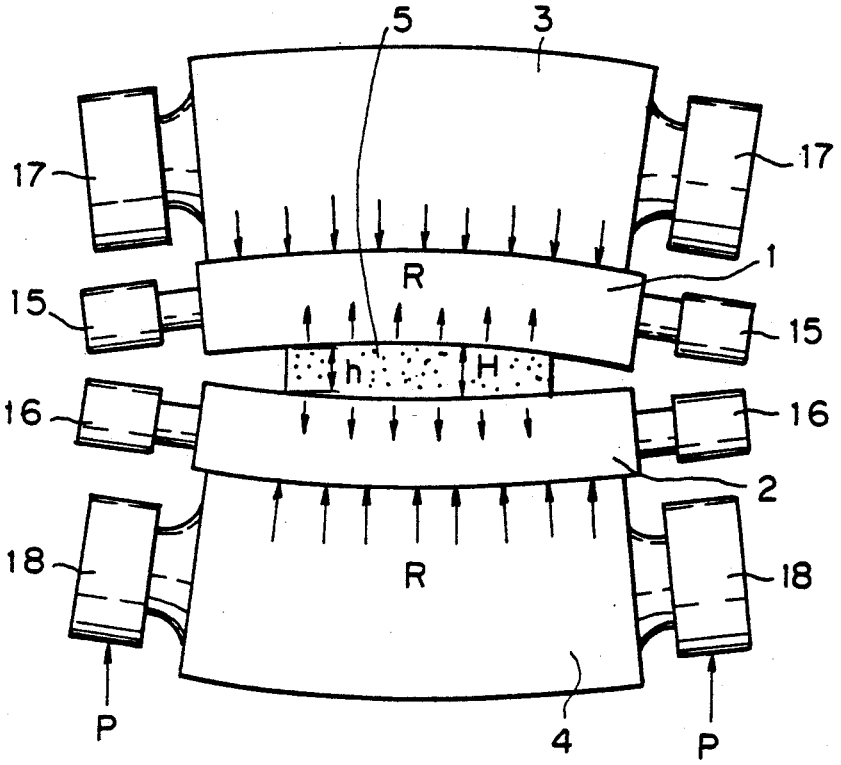
Fig. 12 PRIOR ART
Figure 13A:
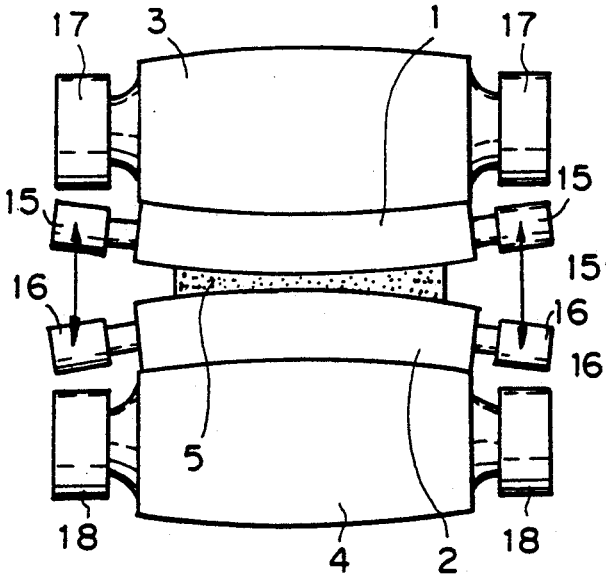
Fig. 13a PRIOR ART
Figure 13B:
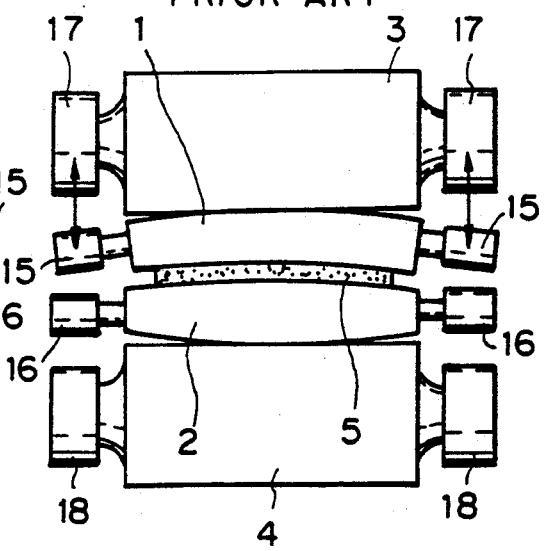
Fig. 13b PRIOR ART
Figure 14:
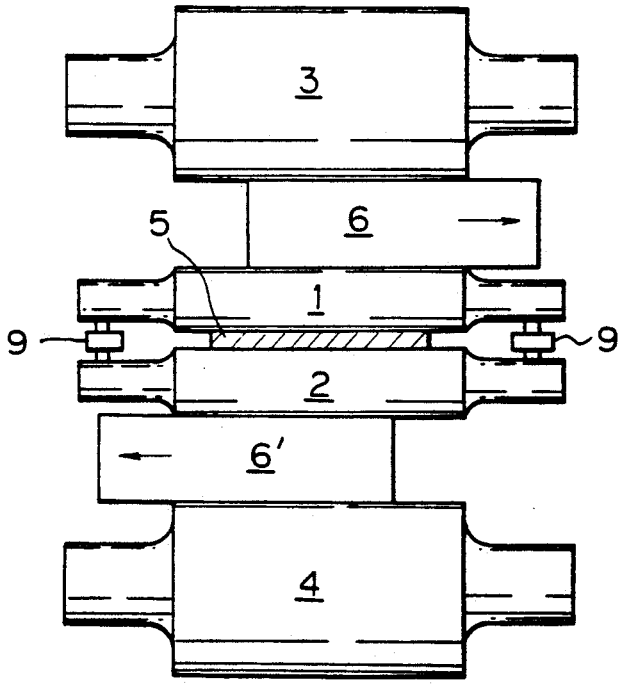
Fig. 14 PRIOR ART
FIG. 14 is a schematic view of another conventional example of a 6-stage rolling machine.

FIG. 6 and FIG. 7 show the test results illustrating how the profiles of upper and lower work rollers 1 and 2 shift depending on the size of bending force if the plate material 5 is rolled by use of the rolling machine 20 of the present invention described above.

FIG. 6 shows the change of the profile of upper work roller 1 in the event that the distance between support rollers 12 has been set to 1400 mm with the roller diameter being 600 mm and the rolling force being 600 ton, and the roller bending force has been adjusted to 125 ton from 0 ton.

FIG. 7 shows the change of profile of upper work roller in the event that the distance between support rollers 12 has been set to 1600 mm with the roller diameter being 600 mm and the rolling force being 600 ton, and the roller bending force has been adjusted to 125 ton from 0 ton.

As clear from FIG. 6 and FIG. 7, the upper work roller 1 can freely adjust the shape from a convex one to a concave one by the bending force and the position of support roller 12, and has a very wide range of shape controlling capabilities and crown controlling capabilities according to the rolling machine 20 of the present invention.

Although the case of using pressure oil as a hydraulic fluid when advancing and retracting the said roller bending rods 9a and 9b has been described, such compressed gases as air, nitrogen gas and so forth may be used.

Furthermore, although the support roller moving electric motor has been used as the drive source when moving the support roller 12 in the axial direction of upper work roller 1, other such transfer means as a hydraulic cylinder and the like may be used.

In addition, it is mentioned that the diameters of upper and lower work rollers 1 and 2 are invariable in the axial direction, but a similar effect can be obtained even if the roller of crown shape having a slight middle height is used.

As clear from the aforementioned explanation, the rolling and correction of plate material can be conducted easily according to the present invention. This is because the profiles of upper and lower work rollers can be controlled securely, easily and moreover speedily over a wide range: by arranging the support roller, upper work roller, lower work roller and back-up roller toward the downward from the upward in this order; making the diameters of upper work roller, lower work roller and back-up roller to be invariable in the axial direction of respective rollers with the support roller providing a contact surface section arranged in contact for free rotation; and moreover by laying out the transfer means for freely advancing and retracting the said support roller in the axial direction of upper work roller. Furthermore, a great number of work rollers and back-up rollers of different initial crown shapes, provided to meet the plate widths and the shape or profile, are no longer necessary, and in turn a few number of work rollers and back-up rollers are required and the product cycles can be enhanced in a wide range. By controlling the position of support roller and the volume of hydraulic fluid guided into the roller bending cylinder engaged with the roller bending rod not only for pushing and bending upward the upper work roller with the contact face of said upper and lower work rollers and the support roller acting as the fulcrums but also for pushing and bending downward the said lower work roller for pressing it on to the surface of lower back-up roller, the profiles of upper work roller and lower work roller can be changed without difficulty, and thereby the plate material can be rolled and corrected easily and quickly.

Conventionally, the entire face of high priced back-up rollers are ground when used, but according to the present invention, the location to be ground is limited only to the support roller portion, which vastly decreases the grinding time and shortens the work time.

In addition, if the position of the support roller is always arranged outside the plate width, a slight degree of flaws on the support roller, if any, will not be transcribed to the plate material via the work roller, so the need for grinding the support roller can be eliminated.

To sum up, the above-mentioned embodiment of the present invention is directed to a 4-stage roller machine or 4 high mill but modified so that an upper back-up roller is not a conventional overall back-up roller but a local back-up roller 60 having rotatable two contact surface sections provided by support rollers 12, while a lower back-up roller is a conventional one, that is an overall back-up roller 6. A pair of work rollers have a constant diameter over the entire work length.

The present invention is not limited to the above modified 4-high mill but provides various kinds of embodiments as follows.

Figure 4:
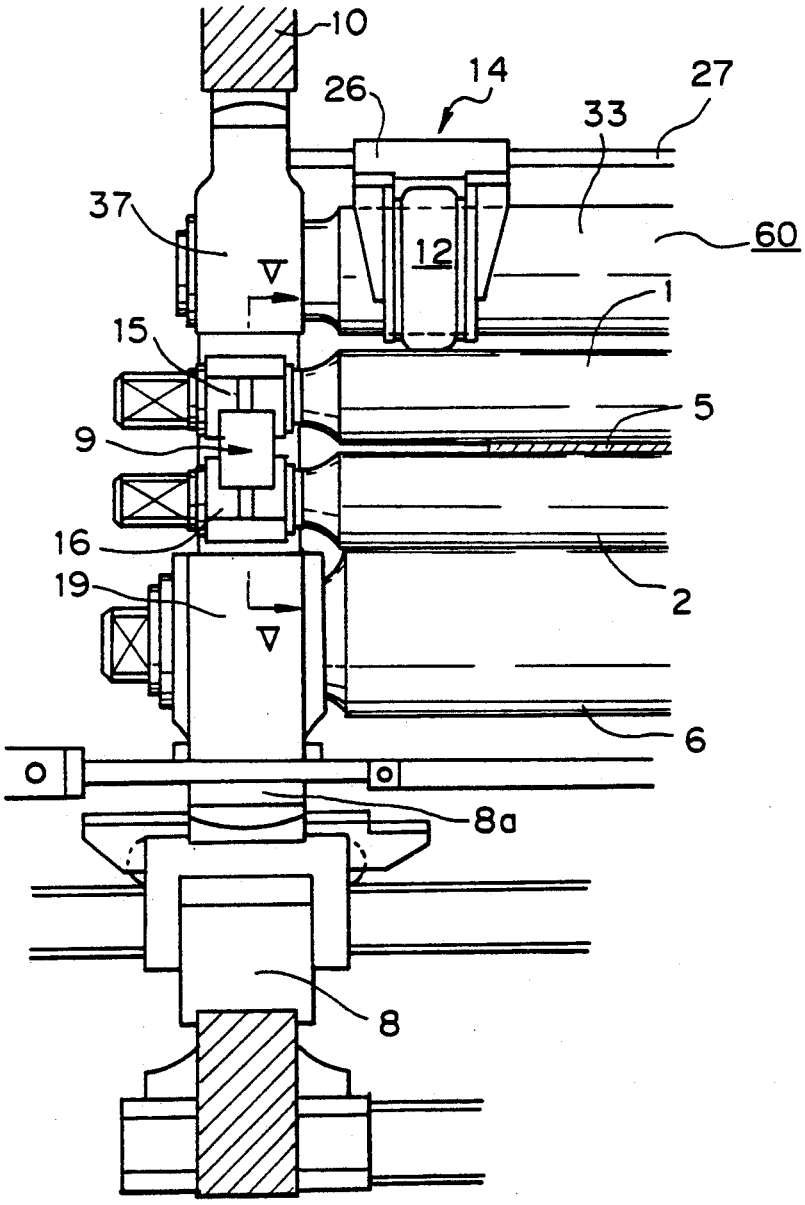
FIG. 4 is an enlarged sectional view showing main portions of the machine from IV—IV of FIG. 2.
Figure 15:
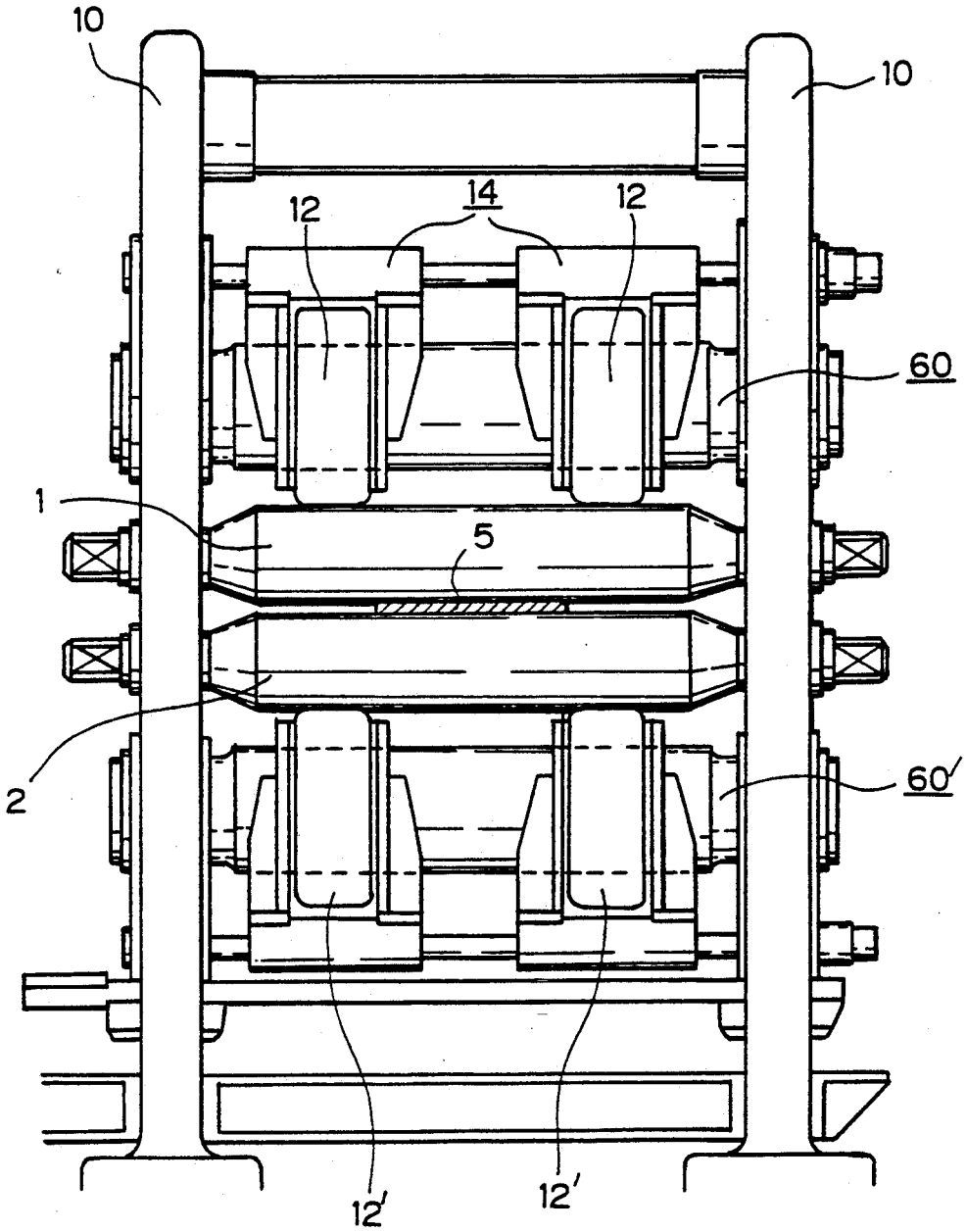
FIG. 15 shows a second embodied mill of the present invention.

FIG. 15 corresponds to FIG. 4 and shows a second embodiment of a 4 stage mill of the present invention. The second embodiment is a mill the same as that of the first one (FIG. 4) except that the lower conventional overall back-up roller 6 of FIG. 4 is substituted by another local back-up roller 60', which is the same as the upper local back-up roller 60.

Figure 5:
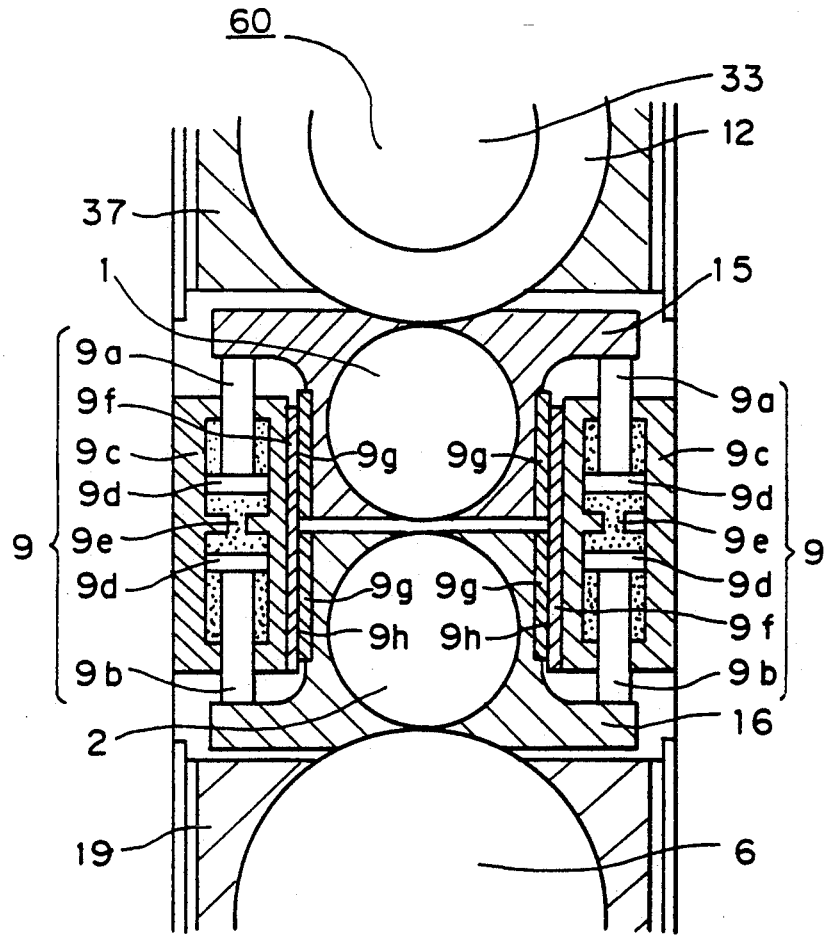
FIG. 5 is an enlarged sectional view showing a roller bending cylinder of the machine from V—V of FIG. 4.
Figure 16:
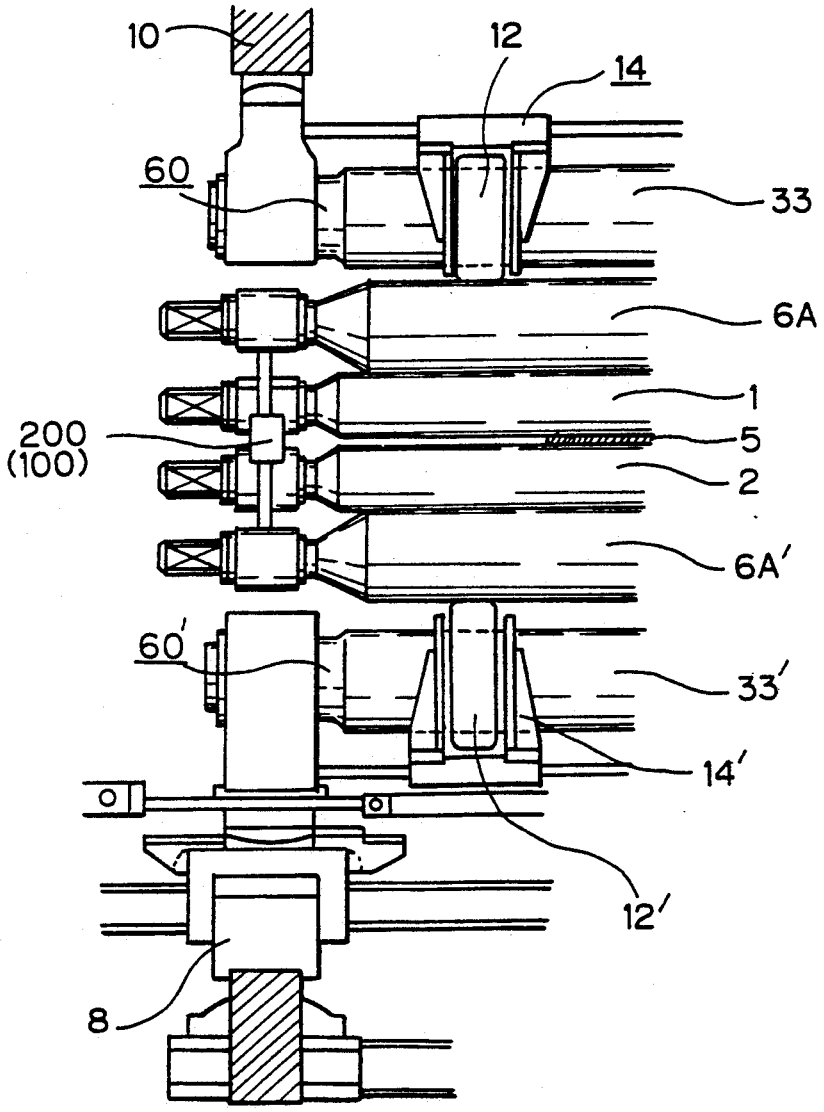
FIGS. 16 and 17 show a third embodied mill of the present invention.
Figure 17:
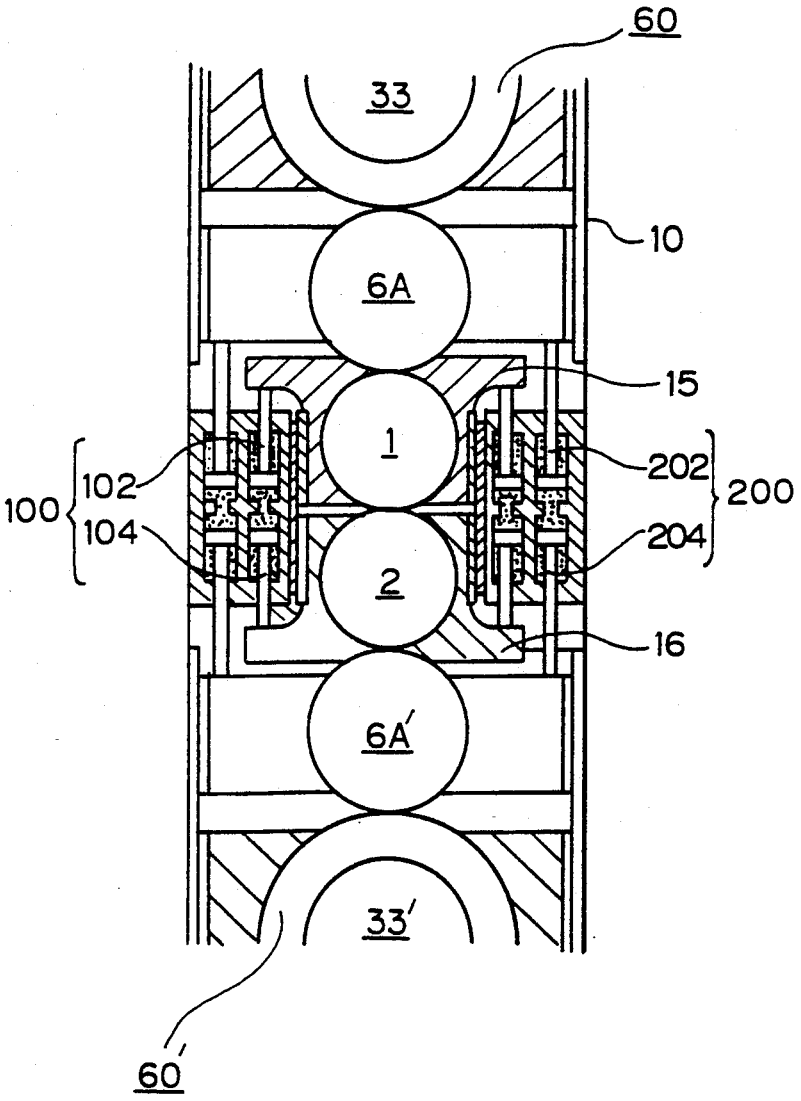

FIGS. 16 and 17 correspond to FIG. 4 or FIG. 15 and FIG. 5, respectively, and show a third embodiment of a 6 stage mill of the present invention. The third embodiment is a mill the same as that of the second one (FIG. 15) except that additional overall back-up rollers 6A and 6A' are provided as intermediate back-up rollers between the upper and lower local back-up rollers 60 and 60' and the upper and lower work rollers 1 and 2, respectively.

As shown in FIG. 17 corresponding to FIG. 5, the third embodied mill has not only the same means 100 for bending the paired work rollers at the opposite ends as those (9) of the first and second embodied mills, but also additional means 200 for bending the paired intermediate rollers 6A and 6A' at the opposite ends. The work rollers 1 and 2 and the intermediate rollers 6A and 6A' usually have diameters constant over the work lengths, respectively.

Before starting the rolling work, the axial positions of support rollers 12 as well as 12' should be predetermined to meet the width of rolled material 5. In this case, the rolling contact positions of support rollers 12 and 12' to the work rollers 1 and 2 should be set that they overlap the sides of rolled material 5. For this initial setting, the work rollers 1 and 2, intermediate rollers 6A and 6A' and support rollers 12 and 12' should first be lightly touching each other using the roller bending rods 102 and 202 as well as a roller balancing cylinder not shown in the figure. And then, a position adjusting motor (not shown) of support rollers 12 and 12' shall be moved to the preset position. Thereby, the interval between the pair of support rollers 12 or 12' are set to a desired interval.

After this initial setting has been completed a rolled material shall be passed between the work rollers 1 and 2. Thereby, the material with a desired strip thickness and shape can be obtained as strip material, and the shape will be determined by a contact system of visual inspection of sensor roller, or by a non-contact system utilizing light or magnet. In the case that there is deformation at the edge portions or the middle area, the bending motion acting on the work rollers 1 and 2 through the intermediate rollers 6A and 6A' shall be adjusted by operating the drive motor for moving the pair of support rollers 12 as well as 12' so that each pair of the support rollers may be mutually attracted or repelled from each other, and thus the appearance of shape abnormality can be eliminated or suppressed and a rectangular strip material can be obtained. Because, in this case, the bending degree of intermediate rollers 6A and 6A' are controlled by increasing or decreasing the bending force by the intermediate roller bending unit 200, a considerable shape correcting function can be obtained by mutual action with the positional movement distance of paired support rollers 12 as well as 12'. In short, the correction area can be adjusted by the positional movements of support rollers 12 as well as 12' and the correction degree can be adjusted by the intermediate roller bending unit 200.

If edge drops occur on the rolled material 5, the bending forces of work rollers 1 and 2 by the work bending unit 100 should be controlled. Because both ends of work rollers 1 and 2 protrude from or extend over the intermediate rollers 6A and 6A', the rods 102 and 104 extend when a pressurized oil is supplied to the bending unit 100, with the result that mainly the portions protruded out of the end brims of intermediate rollers 6A and 6A' are bent largely so as to eliminate the edge drops. Because the work rollers 1 and 2 of course are rigid, the bending forces are transmitted to the intermediate rollers 6A and 6A'.

Because the bending fulcrums at work rollers 1 and 2 or the intermediate rollers 6A and 6A' can be changed freely in accordance with the embodied rolling machine, the roller bending effect can be exhibited to a full extent without being constrained by the conventional back-up rollers of the entire face contact type, that is the overall back-up rollers. In addition, because the positions of upper and lower support rollers 12 as well as 12' can be changed individually, the shape can be controlled at an optional position in the plate width direction. Therefore, the rolling machine is capable of controlling such shape deformation at the middle area or edge portions of rolled material as well as controlling the composite shape deformation where both deformations exist.

Moreover, because this rolling machine is equipped with the work roller bending unit 100 and the intermediate roller bending unit 200, the shape of the overall plate width can be controlled by the intermediate roller bending force while the shape of plate ends such as edge drops and the like can be controlled by the work roller bending force, and hence the control operation becomes much easier. Further, because the paired support rollers 12 as well as 12' can be positioned symmetrically in vertical and horizontal directions, the shape can be controlled symmetrically in the plate thickness direction and plate width direction of rolled material 5, and thus an excellent rolled product can be obtained.

In addition, because the positions of the paired support rollers 12 as well as 12' can be freely adjusted, the contact face between work rollers 1 and 2 and plate width ends can be made smoother by using the roller bending force in combination, and the edge drop preventive effect becomes higher. Moreover, because the diameters of work rollers 1 and 2 can be made smaller thanks to the presence of intermediate rollers 6A and 6A', the rolling load area can be made smaller resulting in the availability of rolling work under high pressure, and the deflection degree of work rollers 1 and 2 and the flattening deformation of rollers can be decreased. Furthermore, because this rolling machine controls both the plate thickness and plate width direction symmetrically in the opposite sides of the plate, the rolled material is stable and doesn't meander while being passed between the work rollers.

Figure 18:
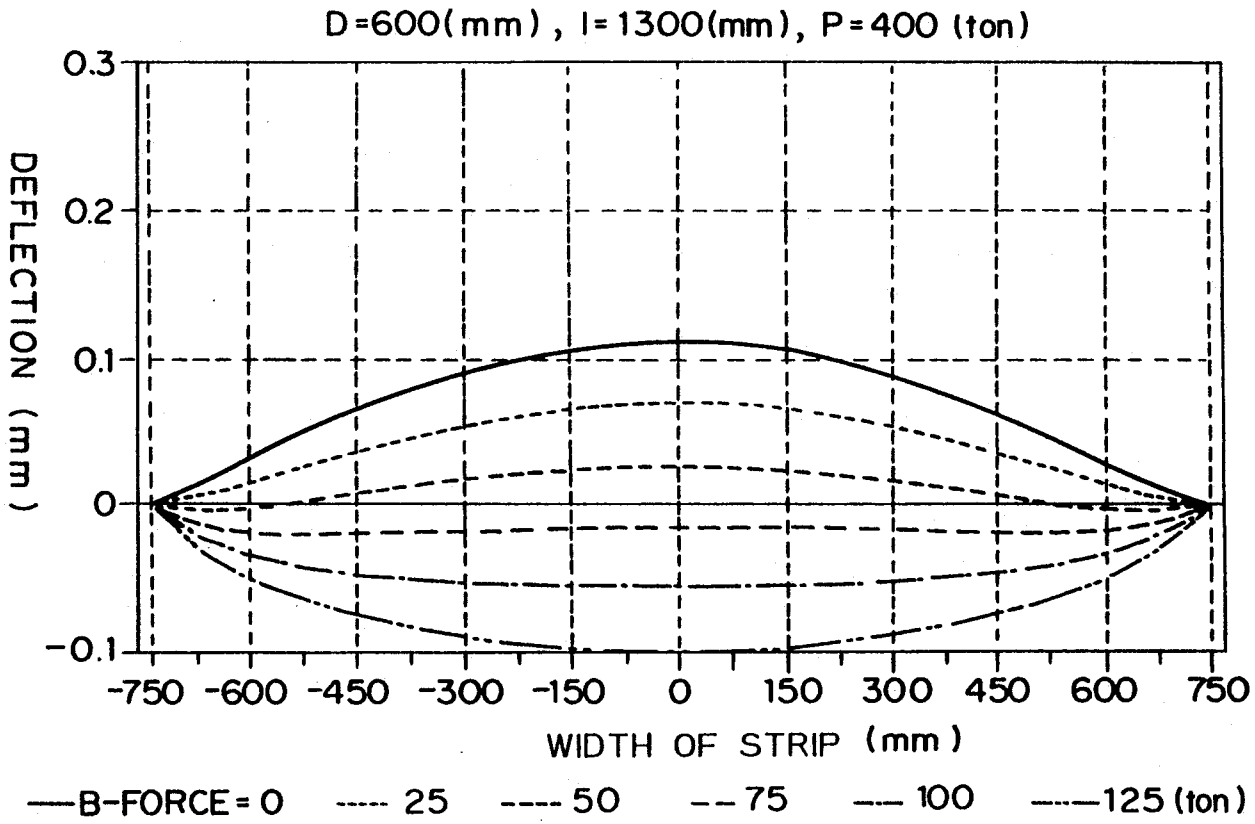
FIGS. 18 and 19 are diagrams showing profiles relating to the control of an upper work roller of a 6-stage mill of the present invention.
Figure 19:
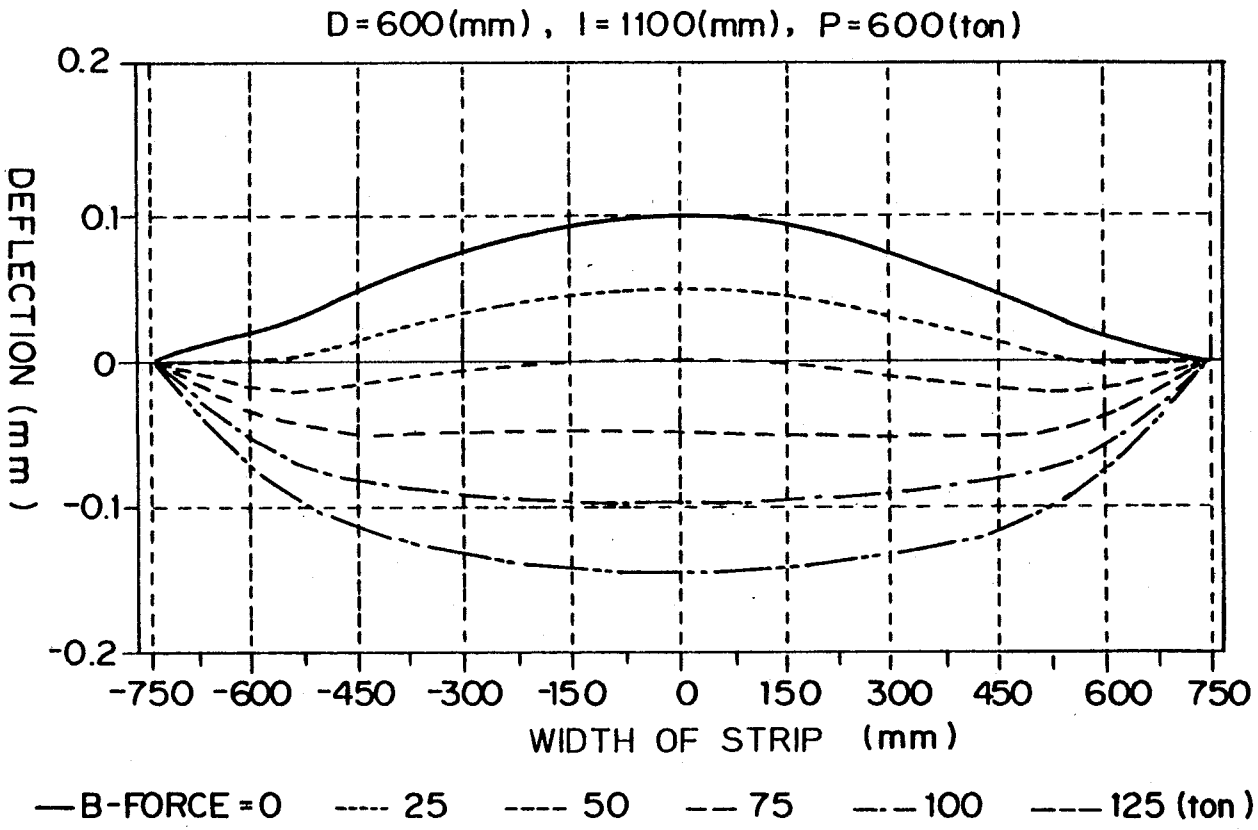

FIG. 18 and FIG. 19 are experimental results showing how the profiles of upper and lower work rollers 1 and 2 vary depending on the size of bending force if a rolled material 5 is rolled by the rolling machine relating to the said embodiment.

FIG. 18 shows the change of profile of upper work roller 1 after having set the work roller diameter to 600 mm, the rolling force to 400 ton, the distance between support rollers to 1,300 mm and the roller bending force from 0 to 125 ton.

Further, FIG. 19 shows the change of profile of upper work roller 1 after having set the work roller diameter to 600 mm, rolling force to 600 ton, the distance between support rollers to 1,100 mm and the roller bending force from 0 to 125 ton.

As can be understood from these results, the work roller deflection degree can be changed optionally depending on the roller bending force and the support roller position and thus the sectional area of strip material can be adjusted. Therefore, the shape controlling and crown controlling functions can be set at a wide range.

The third embodiment may be modified so that the additional bending means 200 are deleted and in turn the diameter of the intermediate back-up rollers 6A, 6A' is decreased to such an extent that it is smaller than that of the work rollers.

Figure 20:
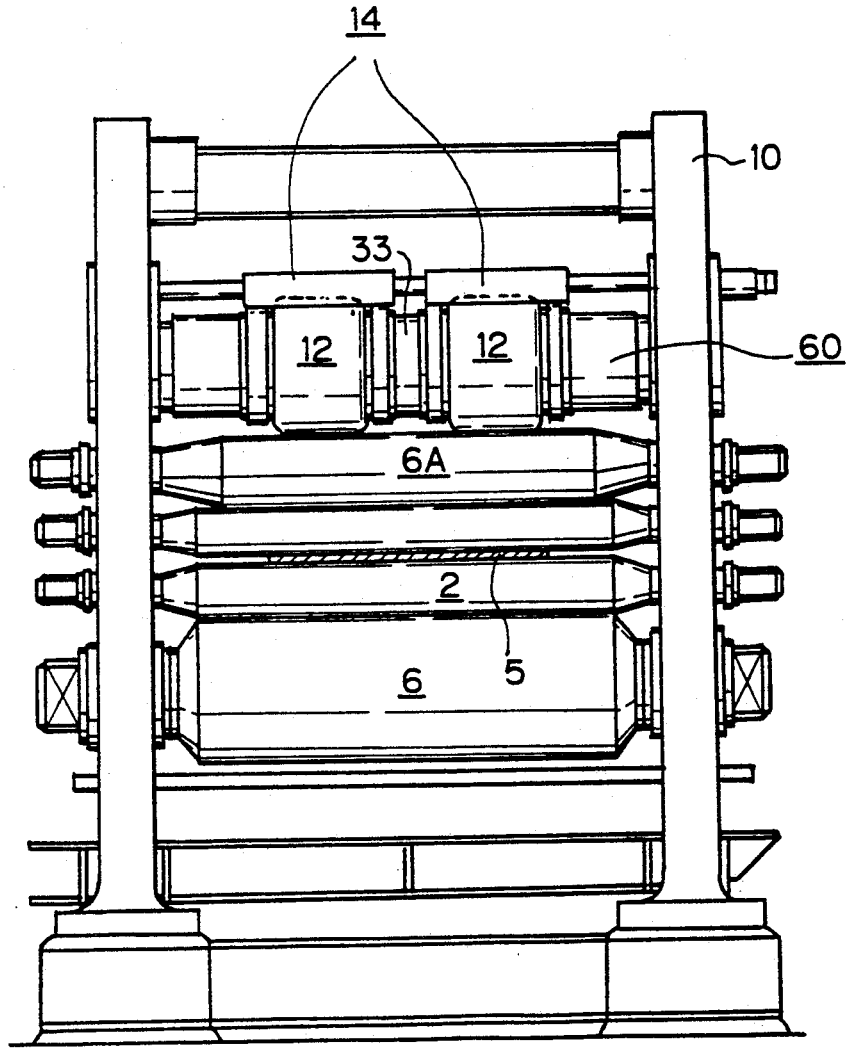
FIG. 20 shows a fourth embodied mill of the present invention.

FIG. 20 corresponds to FIG. 1 and shows a fourth embodiment of a 5 high mill of the present invention, which is the same as the first one except that an overall back-up roller 6A is provided as an intermediate back-up roller between the upper local back-up roller 60 and the upper work roller 1. Not only the means for bending the paired work rollers at the opposite ends but also another means for bending the upper intermediate roller and the lower overall back-up roller at the opposite ends may be provided.

Figure 21:
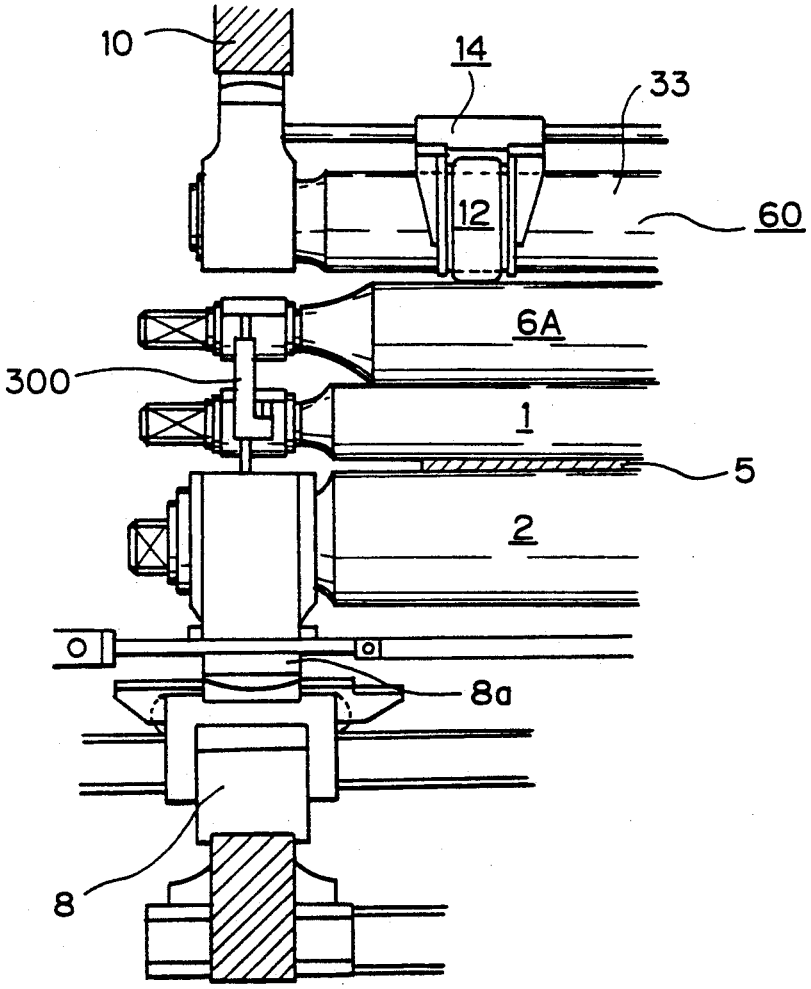
FIG. 21 shows a fifth embodied mill of the present invention.

FIG. 21 corresponds to FIG. 4, and shows a fifth embodiment of a 4 high mill of the present invention, which is the same as that of the fourth one (FIG. 20) except that the lower overall backing-up roller 6 is omitted, and in turn the lower work roller 2 is enlarged so as to have the diameter larger than that of the upper work roller 1. Means 300 for bending the upper intermediate back-up roller 6A and the upper work roller 1 are provided.

With the above mentioned embodiments, it should be noted that the intermediate roller 6A or 6A' are designed so that its work length, on which it can be in contact with a corresponding work roller 1 or 2, is shorter than that of the latter as shown in the figures involved.

Accordingly to the embodied mill involving the intermediate back-up roller 6A mounted for rotation between the local back-up roller 60 and the work roller 1, the support rollers 12 do not damage the surface of the strip in a direct manner, although the intermediate roller 6A may be damaged at its surface by the support roller in a direct manner with roll marks printed thereon in a long rolling run. However, this is advantageous because the intermediate back-up roller can be designed so that it is easier to handle for removal than the work roller, and thus the intermediate roller, may be replaced easily by a fresh roller or a repaired roller as needed before the work roller is substantially damaged by the damaged intermediate roller. Further, the support rollers are apt to be used in axial positions between which the strip is located.

Figure 3A:
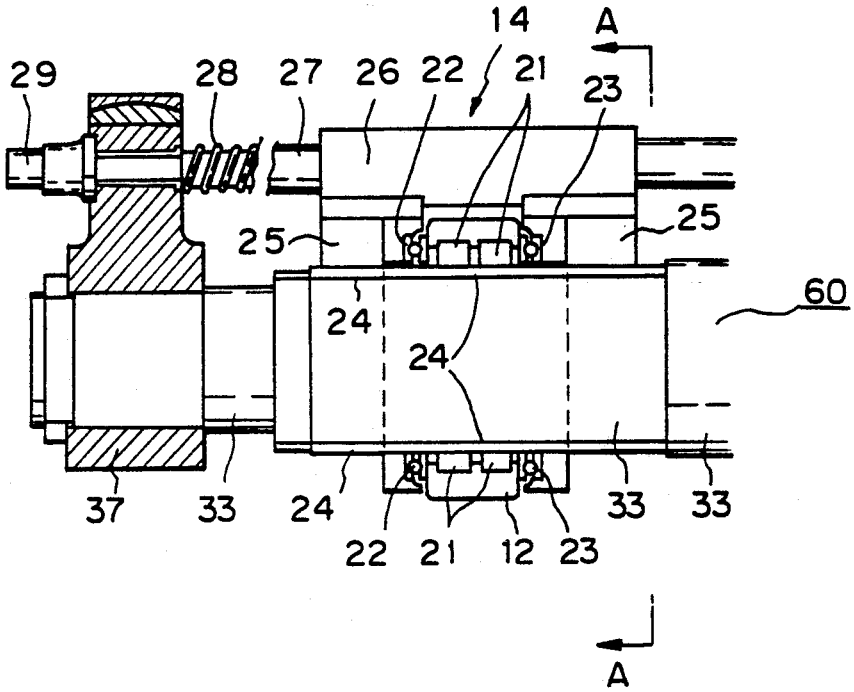
FIG. 3(*a*) is an enlarged partial cross-sectional view showing a local back-up roller of the machine from III—III of FIG. 2.
Figure 3B:
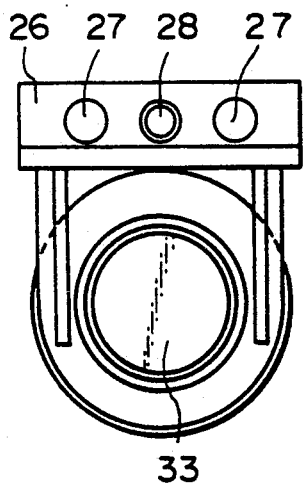

The present invention is not limited to a mill involving the local back-up roller 60 as shown in FIG. 3*a*. The local back-up roller of FIG. 3*a* involves the mainshaft 33, which is axially fixed, and is prevented from rotation, while the support rollers 12 are rotatable relative to the main shaft via the bearings 21, 22 and 23 therebetween.

Figure 22:
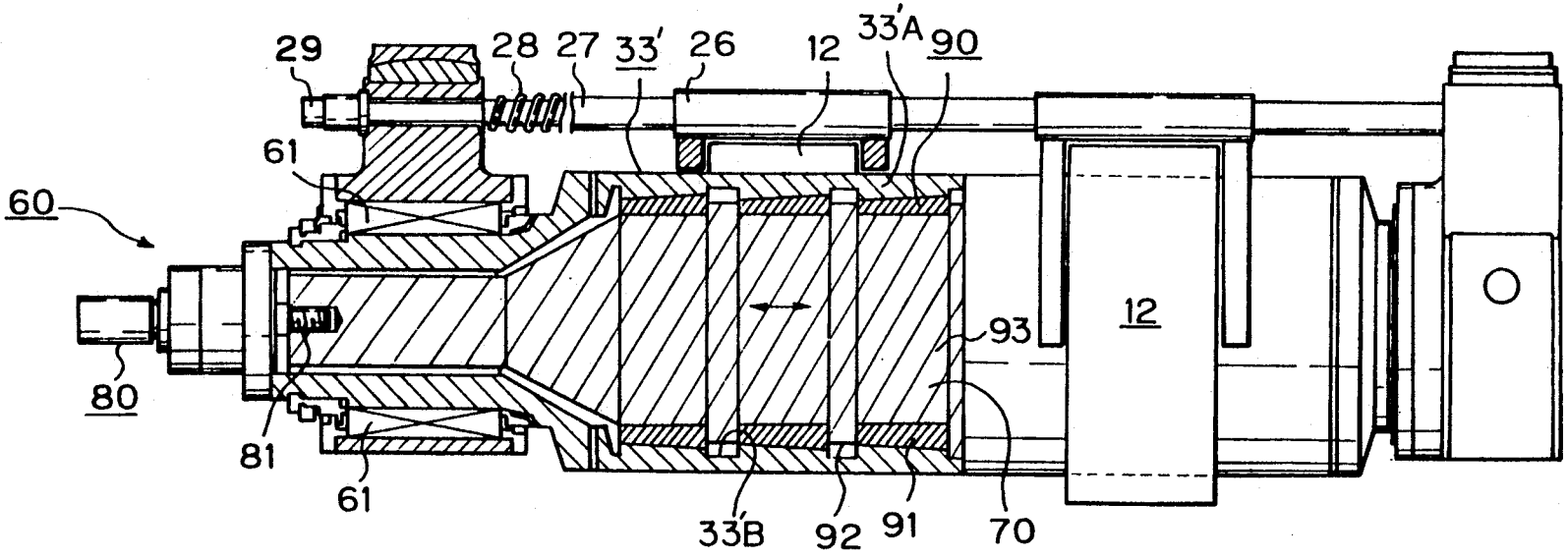
FIG. 22 is a partially cross-sectional view showing another embodied local back-up roller of the present invention, partially corresponding to FIG. 3*a*.
Figure 23A:
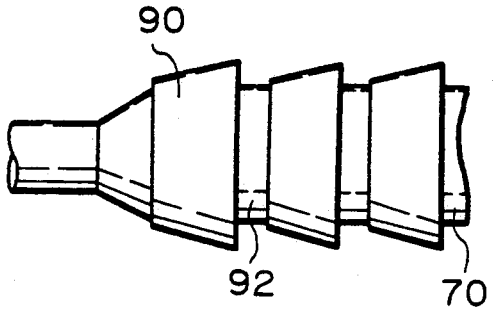
FIGS. 23*a* and 23*b* are schematical views of an inner shaft and an outer main shaft as shown in FIG. 22.
Figure 23B:
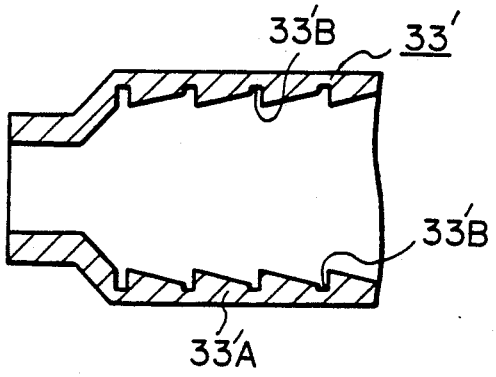

FIGS. 22, 23*a* and 23*b* show another embodiment of a local back-up roller 60 of the present invention. The second embodied roller has a same screw type mechanism as that of the first one (FIG. 3*a*), but is different from the first one as follows.

Referring to FIGS. 22, FIG. 23*a* and FIG. 23*b*, the second embodied local back-up roller 60 has a main hollow shaft 33' which is mounted on the roll stand 10 for rotation via a bearing 61, but is axially fixed. In turn there is no bearing means such as these (21,22,23) of the first embodiment (FIG. 3*a*). There are an inner shaft 70 disposed in the hollow main shaft 33' with an annular gap therebetween, and a hydraulic cylinder 80 having a rotatable plunger 81 provided at one of the standing frames of the roll stand 10 to cause the inner shaft 70 to reciprocate axially.

The plunger 81 is connected to the inner shaft 70. The inner shaft 70 has a plurality of axially arranged tapered wedge surface sections 90, which are preferably formed by curved and tapered wedge shells 91 and fixed to a core 93 of the inner shaft 70. Each wedge surface section 90 has the same diameter increasing in a forward axial direction of the inner shaft from its forward end to its rear end.

The tapered wedge surface sections 90 are axially spaced apart from each other with an annular groove 92 between the neighboring sections.

An inner surface of the hollow main shaft 33' has a profile similar to or corresponding to the outer surface of the inner shaft defined by the wedge shells 91 as shown in FIGS. 22 and 23*b*, to provide tapered contact surface sections 33'A which are axially arranged with a annular groove 33'B between the neighboring sections. The annular groove 33'A has a diameter larger than the maximum diameter of the tapered wedge surface section 90 at the rear end thereof, when the inner shaft 70 is in a wedge non-work axial position relative to the main shaft 33'.

When the inner shaft 70 is shifted to a wedge work portion by driving the hydraulic cylinder 80 as shown in FIG. 22, the tapered wedge surface sections 90 of the inner shaft 70 are press-fitted to corresponding tapered contact surface sections 33'A with the result that the latters 33'A are radially expanded or the outer diameter of the latter is enlarged, so that the inner shaft 70 push radially the hollow main shaft against the support rollers 12. As a result, the inner shaft 70, the main shaft 33' and the support rollers 12 are allowed to rotate as needed in combination with the rotatable plunger 81. In other words, the bearing 61 allows the support rollers 12 to rotate about an axis thereof, when the inner shaft 70 is in a wedge work position, in cooperation with the inner shaft 70 and the main shaft 33'.

When the inner shaft 70 is out of the wedge work position, it is possible to have an axial position of each support roller 12 adjusted as desired, using the screw mechanism.

According to the above second embodiment (FIG. 22), the local back-up roller 61 is reinforced compared with the first embodiment (FIG. 3*a*) during the rolling operation, since the inner shaft 70 and the main shaft 33', in combination, exhibit a composite stiffness of the local back-up roller.

We claim:

1. A mill for producing a continuous strip comprising: a roll stand; inner rollers including a pair of upper and lower work rollers rotatably mounted on the roll stand at opposite ends thereof to receive a metallic material under rolling pressure to form the strip; means provided in the roll stand for exerting a rolling force against the work rollers to produce the rolling pressure; means for bending neck portions of the pair of work rollers provided in the roll stand at opposite ends thereof; at least one local back-up roller each being positioned upper or lower relative to the strip as an outermost roller mounted on the roll stand at opposite ends thereof and having means for defining a surface in contact with an adjacent inner work roller, said surface consisting essentially of a pair of separate surface sections, each section being movable coaxially relative to the axis of the local back-up roller involved and rotatable thereabout and being fixed at a constant radial distance from said axis at any axial position where the section is allowed to move, both sections being axially arranged to have a back-up effect on said adjacent inner work roller at two local areas thereof; and means in each local back-up roller for drivably moving each contact surface section axially relative to the adjacent inner work roller and relative to each other between a position wherein the contact surface sections are in contact with each other and a position where the contact surface sections are spaced apart from each other at a predetermined maximum axial length.

2. A mill according to claim 1, including at least one overall back-up roller with an overall contact surface to have a back-up effect overall on a corresponding work roller, the work rollers being located between the local back-up roller(s) and the overall back-up roller(s).

3. A mill according to claim 1, including another local back-up roller having a pair of corresponding contact surface sections and acting on a different one of said corresponding work rollers.

4. A mill according to claim 1, including an overall back-up roller having an overall contact surface and located between a local back-up roller and a corresponding work roller to act as an intermediate back-up roller.

5. A mill according to claim 4, including another overall back-up roller having an overall contact surface and acting on a different one of said corresponding work rollers.

6. A mill according to claim 5 including means for bending a neck portion of at least one overall back-up roller and a corresponding work roller.

7. A mill according to claim 4 or 5, including means for bending a neck portion of at least one intermediate back-up roller and a corresponding work roller.

8. A mill according to claim 5, including another local back-up roller having a pair of corresponding contact surface sections acting on a different one of said overall back-up rollers which, in turn, acts as an intermediate back-up roller.

9. A mill according to claim 8, including means for bending a neck portion of a pair of said intermediate rollers.

10. A mill according to any one of claims 4, 5 and 8, wherein each intermediate back-up roller has a work length shorter than each corresponding work roller in contact therewith.

11. A mill according to any one of claims 1 to 8, wherein each local back-up roller has a main shaft and a pair of back-up devices, each device comprising: a support roller rotatably and coaxially mounted on the main shaft; a housing axially holding the support roller, a threaded shaft axially screwed into the housing; and means for rotating the thread shaft to thereby adjust an axial position of the support roller, the support rollers providing said contact surface sections of each local back-up roller.

12. A mill according to claim 11, wherein a common threaded shaft is provided, and has a thread portion at one side thereof for one housing of a pair of said housings and an inverse thread portion at the other side thereof for the other housing of said pair of housings, whereby a rotation of the common threaded shaft in one direction causes the paired support rollers to shift oppositely toward a center of the main shaft, while another rotation in the opposite direction causes the paired support rollers to shift oppositely toward the outer ends of the main shaft.

13. A mill according to claim 11, wherein there are two threaded shafts with two rotating means provided for respective support rollers, whereby the respective rotating means cause the thread shafts to be rotated so that a pair of said support rollers are forced to shift independently of each other.

14. A mill according to claim 11, wherein the main shaft is axially and rotatably fixed, each support rollers being rotatable relative to the main shaft via bearing means.

15. A mill according to claim 11, wherein the main shaft is hollow, axially fixed and rotatable around its axis, each support roller has an axial hole to receive the main shaft with a small annular gap, and including: an inner shaft disposed in the hollow main shaft; a hydraulic cylinder having a rotatable axial plunger connected to the inner shaft at an end thereof to shift the inner shaft axially in forward and rearward directions; and wedge means formed at both an inner surface of the hollow main shaft and an outer surface of the inner shaft for causing the inner shaft to radially push the main shaft against a pair of support rollers to render said pair of support rollers, the main shaft and the inner shaft being rotatable with the plunger of the hydraulic cylinder when the inner shaft is shifted relative to the main shaft to a wedge work position, with the hollow main shaft being radially expanded against the support rollers.

16. A mill according to claim 15, wherein the wedge means comprises axially arranged tapered wedge surface sections, each having the same outer diameter increasing in the same axial direction of the inner shaft from a forward end thereof to a rear end thereof, and axially arranged tapered contact surface sections, each having the same inner diameter increasing in said axial direction of the inner shaft from a forward end to a rear end thereof, the contact surface sections of the main shaft being spaced by an annular groove having a substantial axial width, the annular groove of the main shaft having an inner diameter larger than the maximum diameter of a corresponding tapered wedge surface section of the inner shaft at said rear end thereof, the inclination of the tapered contact surface sections being the same as that of the tapered wedge surface sections.

17. A mill according to claim 16, wherein each tapered wedge surface section is formed by a plurality of curved and tapered wedge shells arranged around a core of the inner shaft and fixed thereto.

18. A mill according to claim 1, wherein each work roller and each back-up roller have constant diameters over work lengths thereof, respectively.

19. A mill for producing a continuous strip comprising: a roll stand; inner rollers including a pair of upper and lower work rollers rotatably mounted on the roll stand at opposite ends thereof to receive a metallic material under rolling pressure to form the strip; means provided in the roll stand for exerting a rolling force against the work rollers to produce the rolling pressure; means for bending neck portions of the pair of work rollers provided in the roll stand at opposite ends thereof; at least one local back-up roller each being positioned upper or lower relative to the strip as an outermost roller mounted on the roll stand at opposite ends thereof and having means for defining a surface in contact with an adjacent inner work roller, said surface consisting essentially of a pair of rotatable and axially movable surface sections fixed at a constant radial distance from the axis of the local back-up roller and axially arranged to have a back-up effect on the adjacent work roller at two local areas thereof; and means in the local back-up roller for drivably moving each contact surface section axially relative to the adjacent work roller wherein each local back-up roller has a main shaft and a pair of back-up devices, each back-up device comprising: a support roller rotatably and coaxially mounted on the main shaft; a housing axially holding the support roller, a threaded shaft axially screwed into the housing; and means for rotating the threaded shaft to thereby adjust an axial position of the support roller, the support roller provides said contact surface sections of each local back-up roller, wherein the main shaft is axially and rotatably fixed and the support rollers are rotated relative to the main shaft via bearing means.

20. A mill according to claim 19, including at least one overall back-up roller with an overall contact surface to have a back-up effect overall on a corresponding work roller, the work rollers being located between the local back-up roller(s) and the overall back-up roller(s).

21. A mill according to claim 19, wherein a common threaded shaft is provided, and has a thread portion at one side thereof for one housing of a pair of said housings and an inverse thread portion at the other side thereof for the other housing of the pair of housings, whereby a rotation of the common threaded shaft in one direction causes the paired support rollers to shift oppositely toward a center of the main shaft, while another rotation in the opposite direction causes the paired support rollers to shift oppositely toward the outer ends of the main shaft.

22. A mill according to claim 19, wherein there are two threaded shafts with two rotating means provided for respective support rollers, whereby the respective rotating means cause the threaded shafts to be rotated so a pair of support rollers are forced to shift independently of each other.

23. A mill according to claim 19, wherein the main shaft is hollow, axially fixed and rotatable around its axis, each support roller has an axial hole to receive the main shaft with a small annular gap, and including: an inner shaft disposed in the hollow main shaft; a hydraulic cylinder having a rotatable axial plunger connected to the inner shaft at an end thereof to shift the inner shaft axially in forward and rearward directions; and wedge means formed at both an inner surface of the hollow main shaft and an outer surface of the inner shaft for causing the inner shaft to radially push the main shaft against a pair of support rollers to render said pair of support rollers, the main shaft and the inner shaft being rotatable with the plunger of the hydraulic cylinder when the inner shaft is shifted relative to the main shaft to a wedge work portion, with the hollow main shaft being radially expanded against the support rollers.

24. A mill according to claim 19, wherein each work roller and each back-up roller have constant diameters over work lengths thereof, respectively.

25. A mill according to claim 19, including another local back-up roller having a pair of corresponding contact surface sections and acting on a different one of said corresponding work rollers.

26. A mill according to claim 25, wherein the wedge means comprises axially arranged tapered wedge surface sections, each having the same outer diameter increasing in the same axial direction of the inner shaft from a forward end thereof to a rear end thereof, and axially arranged tapered contact surface sections, each having the same inner diameter increasing in said axial direction of the inner shaft from a forward end to a rear end thereof, the contact surface sections of the main shaft being spaced by an annular groove having a substantial axial width, the annular groove of the main shaft having an inner diameter larger than the maximum diameter of a corresponding tapered wedge surface section of the inner shaft at said rear end thereof, the inclination of the tapered contact surface sections being the same as that of the tapered wedge surface sections.

27. A mill according to claim 26, wherein each tapered wedge surface section is formed by a plurality of curved and tapered wedge shells arranged around a core of the inner shaft and fixed thereto.

28. A mill according to claim 19, including an overall back-up roller having an overall contact surface and located between a local back-up roller and a corresponding work roller to act as an intermediate back-up roller.

29. A mill according to claim 28, including another overall back-up roller having an overall contact surface and acting on a different one of said corresponding work rollers.

30. A mill according to claim 28 or 29, including means for bending a neck portion of at least one intermediate back-up roller and a corresponding work roller.

31. A mill according to claim 29 including means for bending a neck portion of at least one overall back-up roller and a corresponding work roller.

32. A mill according to claim 29, including another local back-up roller having a pair of corresponding contact surface sections acting on a different one of said overall back-up rollers which, in turn, acts as an intermediate back-up roller.

33. A mill according to claim 32, including means for bending a neck portion of a pair of said intermediate rollers.

34. A mill according to claims 28, 29 and 32, wherein each intermediate back-up roller has a work length shorter than each corresponding work roller in contact therewith.

35. A method of producing a strip comprising:

(i) providing a mill comprising a roll stand; inner rollers including a pair of upper and lower work rollers rotatably mounted on the roll stand at opposite ends thereof to receive a metallic material under rolling pressure to form the strip; means provided in the roll stand for exerting a rolling force against the work rollers to produce the rolling pressure; means for bending neck portions of the pair of work rollers provided in the roll stand at opposite ends thereof; at least one local back-up roller each being positioned upper or lower relative to the strip as an outermost roller mounted on the roll stand at opposite ends thereof and having means for defining a surface in contact with an adjacent inner work roller, said surface consisting essentially of a pair of rotatable and axially movable surface sections fixed at a constant radial distance from the axis of the local back-up roller and axially arranged to have a back-up effect on the adjacent work roller at two local areas thereof; and means in the local back-up roller for drivably moving each contact surface section axially relative to the adjacent work roller wherein each local back-up roller has a main shaft and a pair of back-up devices, each device comprising: a support roller rotatably and coaxially mounted on the main shaft; a housing axially holding the support roller, a threaded shaft axially screwed into the housing; and means for rotating the threaded shaft to thereby adjust an axial position of the support roller, the support roller provides said contact surface sections of each local back-up roller, wherein the main shaft is axially and rotatably fixed and the support rollers are rotated relative to the main shaft via bearing means; and (ii) adjusting the axial positions of the contact surface sections of each local back-up roller, feeding a metallic material between said upper and lower work rollers and controlling the roller bending means in response to a profile of the strip.

36. A method of producing a strip according to claim 35, wherein said mill includes intermediate rollers between the work roller(s) and local back-up rollers, and said method further comprises adjusting the axial positions of the contact surface sections of each lock back-up roller, and controlling each roller bending means in response to a profile of the strip, wherein each contacting surface section of each local back-up roller acts as a fulcrum against a work roller and an intermediate roller when the roller is bent by the roller bending means.

37. A method of producing a strip comprising:

(i) providing a mill comprising a roll stand; inner rollers including a pair of upper and lower work rollers rotatably mounted on the roll stand at opposite ends thereof to receive a metallic material under rolling pressure to form the strip; means provided in the roll stand for exerting a rolling force against the work rollers to produce the rolling pressure; means for bending neck portions of the pair of work rollers provided in the roll stand at opposite ends thereof; at least one local back-up roller each being positioned upper or lower relative to the strip as an outermost roller mounted on the roll stand at opposite ends thereof and having means for defining a surface in contact with an adjacent inner work roller, said surface consisting essentially of a pair of separate surface sections, each section being movable coaxially relative to the axis of the local back-up roller involved and rotatable thereabout and being fixed at a constant radial distance from said axis at any axial position where the section is allowed to move, both sections being axially arranged to have a back-up effect on said adjacent inner work roller at two local areas thereof; and means in each local back-up roller for drivably moving each contact surface section axially relative to the adjacent inner work roller and relative to each other between a position wherein the contact surface sections are in contact with each other and a position where the contact surface sections are spaced apart from each other at a predetermined maximum axial length; and (ii) adjusting the axial positions of the contact surface sections of each local back-up roller, feeding a metallic material between said upper and lower work rollers and controlling the roller bending means in response to a profile of the strip.

* * * * *